US005200303A

United States Patent [19]

Takahashi et al.

[11] Patent Number: 5,200,303

[45] Date of Patent: Apr. 6, 1993

[54] METHOD OF FORMING A COLOR IMAGE FROM SILVER HALIDE PHOTOSENSITIVE MATERIALS CONTAINING CYAN COUPLER WITH HIGH VISCOSITY ORGANIC SOLVENT AND POLYMER

[75] Inventors: Osamu Takahashi; Yoshio Seoka; Hidetoshi Kobayashi; Tsumoru Ishii, all of Kanagawa, Japan

[73] Assignee: Fuji Photo Film Co., Ltd., Kanagawa, Japan

[21] Appl. No.: 668,791

[22] Filed: Feb. 1, 1991

Related U.S. Application Data

[62] Division of Ser. No. 389,157, Aug. 3, 1989, abandoned.

[30] Foreign Application Priority Data

Aug. 4, 1988 [JP] Japan ..... 63-194860

[51] Int. Cl.[5] ..... G03C 5/30

[52] U.S. Cl. ..... 430/377; 430/384; 430/385; 430/434; 430/435; 430/545; 430/546; 430/552

[58] Field of Search ..... 430/552, 553, 545, 546, 430/377, 384, 385, 434, 435, 464, 467, 567

[56] References Cited

U.S. PATENT DOCUMENTS

| | | | |
|---|---|---|---|
| 3,619,195 | 11/1971 | VanCampen | 430/546 |
| 4,201,589 | 5/1980 | Sakaguchi et al. | 430/139 |
| 4,770,987 | 9/1988 | Takahashi et al. | 430/546 |
| 4,822,728 | 4/1989 | Loiacono et al. | 430/545 |
| 4,857,449 | 8/1989 | Ogawa et al. | 430/550 |
| 5,006,453 | 4/1991 | Takahashi et al. | 430/546 |
| 5,047,314 | 9/1991 | Sakai et al. | 430/505 |
| 5,057,408 | 10/1991 | Takahashi et al. | 430/546 |

FOREIGN PATENT DOCUMENTS

| | | | |
|---|---|---|---|
| 0276319 | 7/1987 | European Pat. Off. . | |
| 0256531 | 2/1988 | European Pat. Off. | 430/552 |
| 0280238 | 2/1988 | European Pat. Off. . | |
| 0320821 | 12/1988 | European Pat. Off. . | |
| 1954467 | 10/1969 | Fed. Rep. of Germany . | |
| 2173466 | 7/1987 | Japan | 430/553 |
| 3287850 | 11/1988 | Japan | 430/546 |
| 8800723 | 1/1988 | PCT Int'l Appl. | 430/553 |

*Primary Examiner*—Lee C. Wright

*Attorney, Agent, or Firm*—Sughrue, Mion, Zinn, Macpeak & Seas

[57] ABSTRACT

A light-sensitive silver halide material composed of a support having thereon at least one light-sensitive silver halide emulsion layer, at least one layer of the light-sensitive silver halide emulsion layer or an adjacent layer thereof containing an oil droplet dispersion in a hydrophilic binder, the oil droplets containing the combination of (a) a polymer insoluble in water and soluble in an organic solvent; (b) a high boiling point organic solvent having a viscosity at 25° C. of at least 500 cp and a boiling point of at least 120° C.; and (c) at least one coupler capable of forming a non-diffusible cyan dye by a coupling reaction with an oxidized form of a primary aromatic amine developing agent.

1 Claim, No Drawings

METHOD OF FORMING A COLOR IMAGE FROM SILVER HALIDE PHOTOSENSITIVE MATERIALS CONTAINING CYAN COUPLER WITH HIGH VISCOSITY ORGANIC SOLVENT AND POLYMER

This is a divisional of application Ser. No. 07/389,157, filed Aug. 3, 1989, now abandoned.

FIELD OF THE INVENTION

This invention concerns silver halide based color photographic photosensitive materials and, more precisely, it concerns color photographic photosensitive materials in which the fading of the dye image which is caused by the fungi which develop when processed color photographs are stored under conditions of high temperature and humidity is prevented effectively.

BACKGROUND OF THE INVENTION

It is known that the image dyes in color photographs are liable to fade as a result of the presence of fungi, in addition to the usual fading effects due to heat and light. Photographic photosensitive materials are often stored by being adhered or sandwiched in an album made from paper or on a mounting board, or by being sandwiched on Japanese paper with a mounting board on the surface. However, when photographs are finished for storage in this way the paste used for adhesion and the paper fibers themselves provide nutrient sources. Fungi grow and proliferate, especially under conditions of high temperature and humidity, and problems arise with fading of the image dyes, especially the cyan dyes, as a result of the action of products excreted by the fungi.

The fungi themselves can be wiped off the photograph, but the fading cannot be restored in this way and the quality of the image is permanently degraded. This is a serious problem.

Attempts have been made in the past to overcome this problem by using fungicides (biocides). There are very many fungicides that have been used successfully in many applications, and they could be used with silver halides. However, none has been found which has the desired fungicidal effect without having an adverse effect on various photographic characteristics, or being toxic to humans.

Known fungicides include those disclosed, for example, in U.S. Pat. Nos. 2,226,183, 2,762,708, 2,897,081, 3,185,571, 2,663,639, 3,503,746, 3,342,810 and 3,778,276, British Patents 987,010 and 1,065,920, and JP-A-57-157244 (the term "JP-A" as used herein refers to a "published unexamined Japanese patent application").

However, virtually all of these fungicides are organic fungicides and they may be expensive, or liable to oxidization or sublimation. They have the disadvantage that their effect during the storage of photographic photosensitive materials is poorly retained.

It has been indicated in JP-A-61-233743 that a fungicidal effect can be obtained with little staining and without the occurrence of photostaining by using combinations of specified fungicides and pyrazoloazole based magenta couplers.

It has also been proposed that fungi are not likely to grow if the photosensitive material is made acidic after processing, but such a procedure gives rise to the following problems in practice.

(1) Use of known organic acids (for example, citric or acetic acids) has the opposite effect and provides nutrients for fungi, thus promoting the growth of fungi and increasing the fading.

(2) On acidification to such an extent that fungal growth does not occur, dye fading is liable to occur as a result of the effect of the acid, and the overall storage properties of the image are worsened. This effect is especially pronounced when inorganic acids are used.

On the basis of the facts outlined above, it has been indicated in JP-A-60-135942, corresponding to EP 147016 A2, that the problem can be overcome by lowering the pH of the photosensitive material by immersing the material in an aqueous solution of an ammonium salt (for example, ammonium sulfate) after processing and releasing the ammonium ion from the photosensitive material as ammonia.

However, although good results can be obtained in this way, the situation is the same as that described earlier once the ammonia has been liberated and dispersed, and this method does not provide a real solution to the problem.

A technique is desired by which the fading due to action of material excreted by fungi can be prevented even when fungi are present.

It has been proposed that a cyan coupler, high boiling organic solvent and water-insoluble and organic solvent-soluble polymer are disclosed in WO 88/00723, EP 280238 and JP-A-63-104050, etc.

SUMMARY OF THE INVENTION

One object of the present invention is to provide silver halide color photosensitive materials for color photographs without image deterioration, such as fading, even on storage under adverse conditions of high temperature and humidity under which fungi flourish.

A further object of the invention is to provide silver halide color photosensitive materials for color photographs in which the cyan image has the proper hue, and which have good light fastness and little fading due to fungi.

As a result of various investigations, the inventors have discovered that these and other objects of the present invention can be achieved by a light-sensitive silver halide material composed of a support having thereon at least one light-sensitive silver halide emulsion layer, at least one layer of the light-sensitive silver halide emulsion layer or an adjacent layer thereof containing an oil droplet dispersion in a hydrophilic binder, the oil droplets containing the combination of (a) a polymer insoluble in water and soluble in an organic solvent; (b) a high boiling point organic solvent having a viscosity at 25° C. of at least 500 cp and a boiling point of at least 120° C.; and (c) at least one coupler capable of forming a nondiffusible cyan dye by a coupling reaction with an oxidized form of a primary aromatic amine development agent.

DETAILED DESCRIPTION OF THE INVENTION

The invention is described in greater detail below.

A coupler represented by formula (I) is a preferred cyan dye-forming coupler.

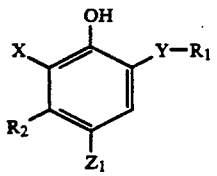

(I)

wherein Y represents —NHCO— or —CONH—, $R_1$ represents a substituted or unsubstituted aliphatic group, substituted or unsubstituted aromatic group, substituted or unsubstituted heterocyclic group or a substituted or unsubstituted amino group; X represents hydrogen, a halogen atom, a substituted or unsubstituted aliphatic group, a substituted or unsubstituted alkoxy group or a substituted or unsubstituted acylamino group; $R_2$ represents a substituted or unsubstituted alkyl group or a substituted or unsubstituted acylamino group; X and $R_2$ may be linked to form a 5- to 7-membered ring; and $Z_1$ represents hydrogen or a group which can be eliminated on coupling with the oxidized form of a developing agent, referred to herein as a "coupling-off group".

In formula (I), $R_1$ preferably represents a linear or cyclic aliphatic group which preferably has from 1 to 32 carbon atoms (for example, methyl, butyl, pentadecyl, cyclohexyl), an aromatic group (for example, phenyl, naphthyl), a heterocyclic group, preferably including a nitrogen atom, (for example, 2-pyridyl, 3-pyridyl, 2-furanyl, 2-oxazolyl) or an amino group, and these groups are preferably substituted with at least one substituent group selected from the alkyl groups, aryl groups, alkyloxy or aryloxy groups (for example, methoxy, dodecyloxy, methoxyethoxy, phenoxy, 2,4-di-tert-amylphenoxy, 3-tert-butyl-4-hydroxyphenoxy, naphthyloxy), carboxyl groups, alkylcarbonyl or arylcarbonyl groups (for example, acetyl, tetradecanoyl, benzoyl), alkyloxycarbonyl or aryloxycarbonyl groups (for example, methoxycarbonyl, benzyloxycarbonyl, phenoxycarbonyl), acyloxy groups (for example, acetyl, benzoyloxy, phenylcarbonyloxy), sulfamoyl groups (for example, N-ethylsulfamoyl, N-octylsulfamoyl), carbamoyl groups (for example, N-ethylcarbamoyl, N-methyldodecylcarbamoyl), sulfonamido groups (for example, methanesulfonamido, benzenesulfonamido), acylamino groups (for example, acetylamino, benzamido, ethoxycarbonylamino, phenylaminocarbonylamino), imido groups (for example, succinimido, hydantoinyl), sulfonyl groups (for example, methanesulfonyl), hydroxyl groups, cyano groups, nitro groups and halogen atoms.

The term "aliphatic group" as used herein signifies a linear chain, branched or ring aliphatic hydrocarbyl group, and this group may be either saturated or unsaturated, being an alkyl group, an alkenyl group or an alkynyl group.

$R_2$ preferably represents an alkyl group which has from 1 to 20 carbon atoms (for example, methyl, ethyl, butyl, pentadecyl) or an acylamino group (for example, tetradecanoylamino, benzoylamino, 2-(2,4-di-tert-amylphenoxy)butanamido).

X represents hydrogen, a halogen atom, aliphatic group, preferably lower alkyl group, (for example, methyl, propyl, allyl), alkoxy group (for example, methoxy, butoxy) or acylamino group (for example, acetamido).

The aforementioned compounds are preferably carbostyryl based cyan couplers in which $R_2$ and X are joined together to form a 5-, 6- or 7-membered ring which preferably includes a nitrogen atom, rather than phenol based cyan couplers, and oxyindole and imidazol-2-one cyan couplers are especially desirable as condensed couplers of this type.

$Z_1$ represents hydrogen or a coupling-off group and examples of such groups include halogen atoms (for example, fluorine, chlorine, bromine), alkoxy groups (for example, ethoxy, dodecyloxy, methoxycarbamoylmethoxy, carboxypropyloxy, methylsulfonylethoxy), aryloxy groups (for example, 4-chlorophenoxy, 4-methoxyphenoxy, 4-carboxyphenoxy), acyloxy groups (for example, acetoxy, tetradecanoyloxy, benzoyloxy), sulfonyloxy groups (for example, methanesulfonyloxy, toluenesulfonyloxy), amido groups (for example, dichloroacetylamino, heptabutyrylamino, methanesulfonylamino, toluenesulfonylamino), alkoxycarbonyloxy groups (for example, ethoxycarbonyloxy, benzyloxycarbonyloxy), aryloxycarbonyloxy groups (for example, phenoxycarbonyloxy), aliphatic or aromatic thio groups (for example, ethylthio, phenylthio, tetrazolylthio), imido groups (for example, succinimido, hydantoinyl), N-heterocyclic groups (for example, 1-pyrazolyl, 1-benzotriazolyl), and aromatic azo groups (for example, phenylazo). These leaving groups may contain photographically useful groups.

From the viewpoint of hue and antifading characteristics, $R_2$ is preferably an alkyl group which has from 1 to 15 carbon atoms, and most desirably from 1 to 4 carbon atoms. $Z_1$ is preferably hydrogen or a halogen atom, and most preferably a halogen atom. Furthermore, X is preferably a halogen atom.

Specific examples of cyan couplers which can be used in the invention are indicated below, but the present invention is not to be construed as being limited to these examples.

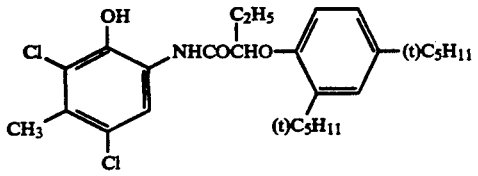

(C-1)

-continued
(C-2)
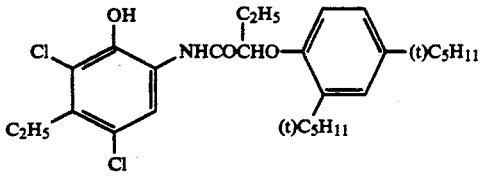
(C-3)
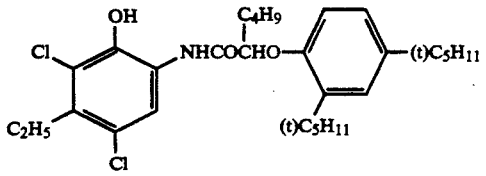
(C-4)
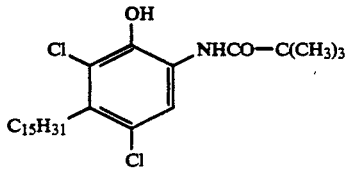
(C-5)
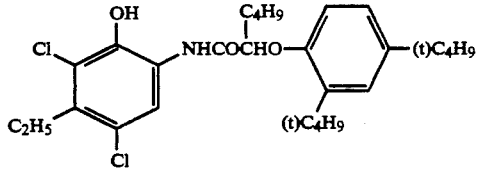
(C-6)
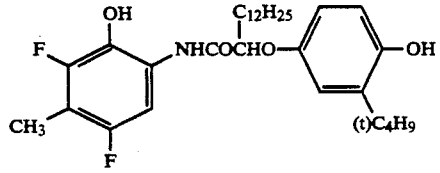
(C-7)
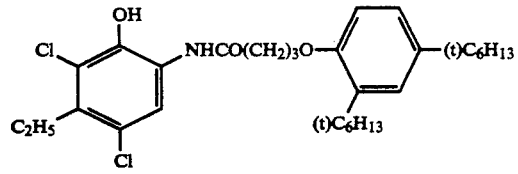
(C-8)
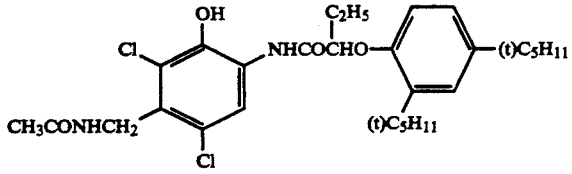
(C-9)
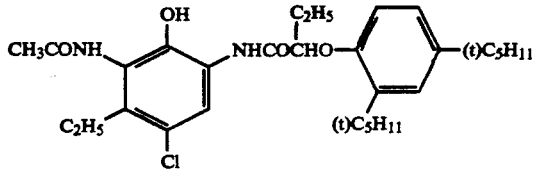

-continued
(C-10)
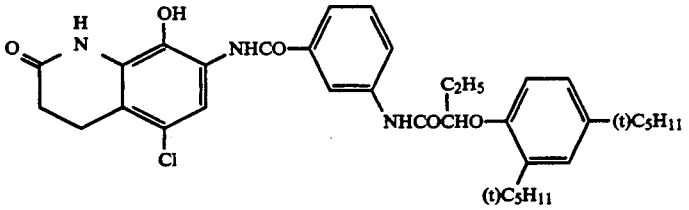
(C-11)
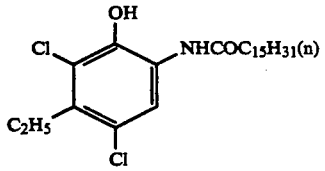
(C-12)
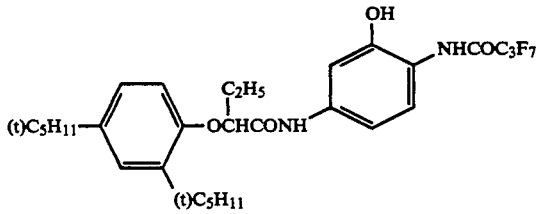
(C-13)
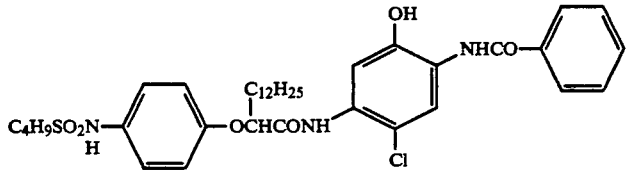
(C-14)
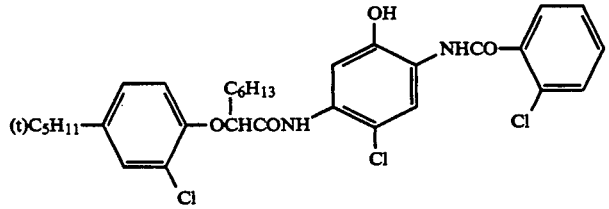
(C-15)
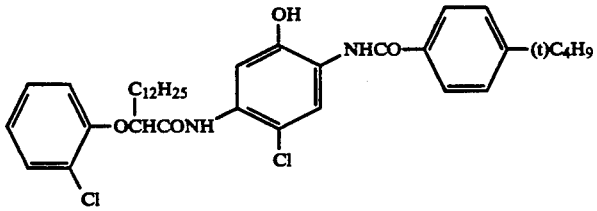
(C-16)
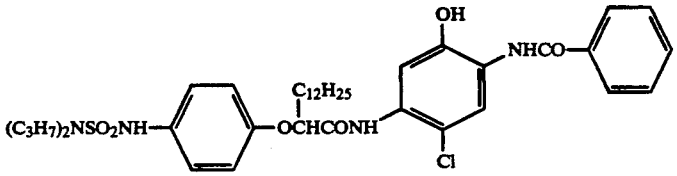

-continued
(C-17)
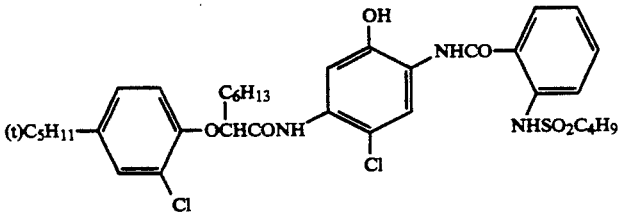
(C-18)
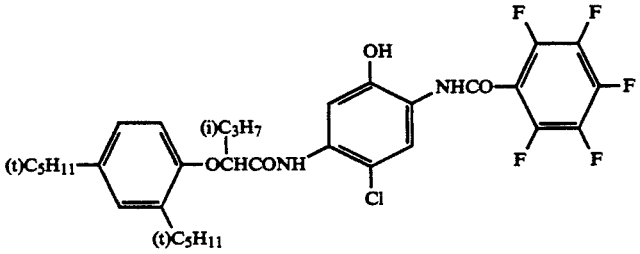
(C-19)
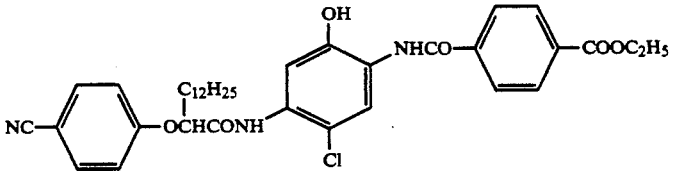
(C-20)
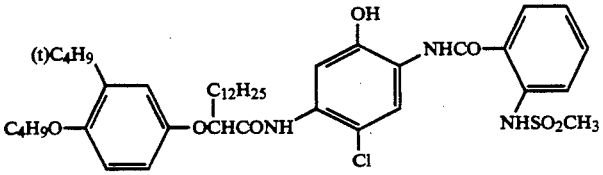
(C-21)
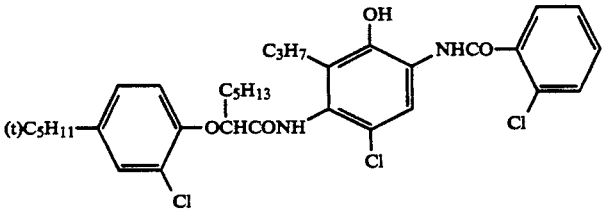
(C-22)
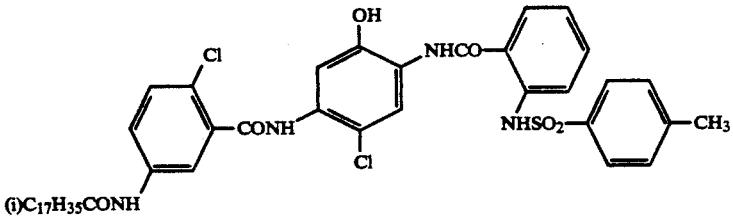
(C-23)
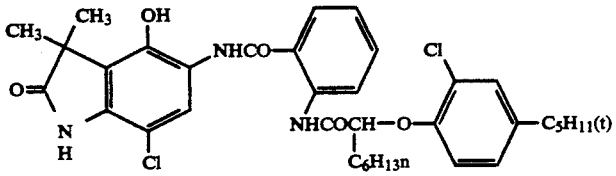

-continued
(C-24)
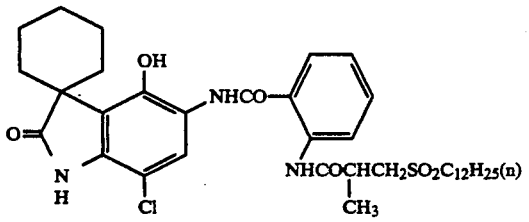
(C-25)
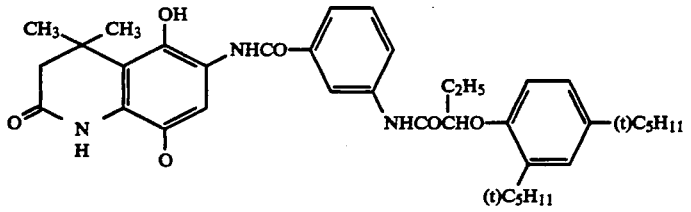
(C-26)
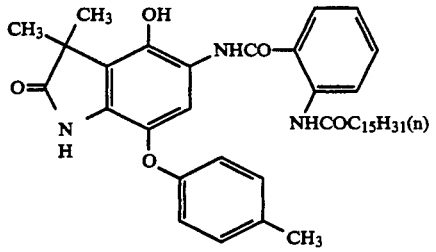
(C-27)
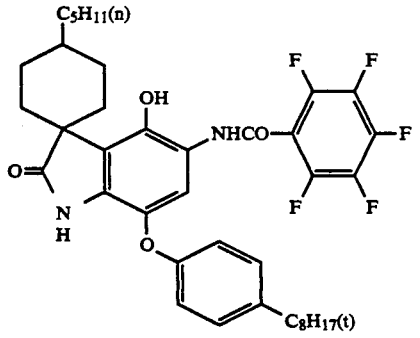
(C-28)
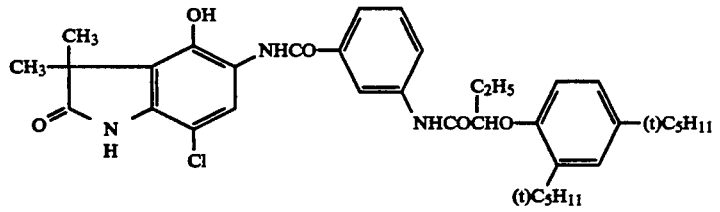
(C-29)
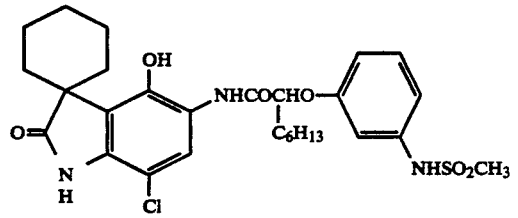

-continued
(C-30)
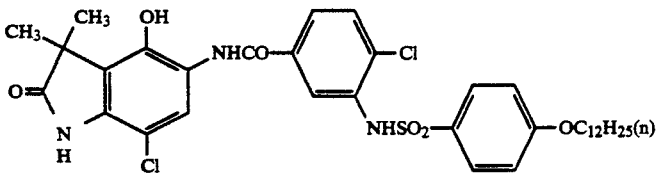
(C-31)
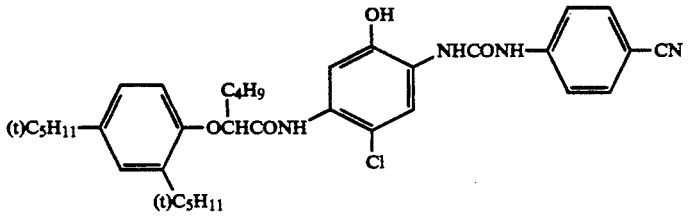
(C-32)
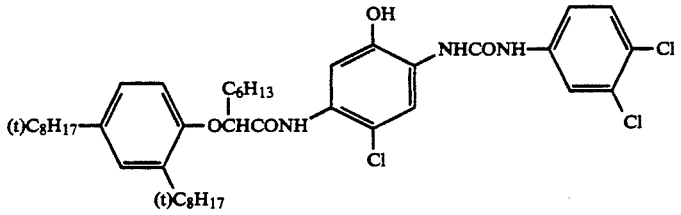
(C-33)
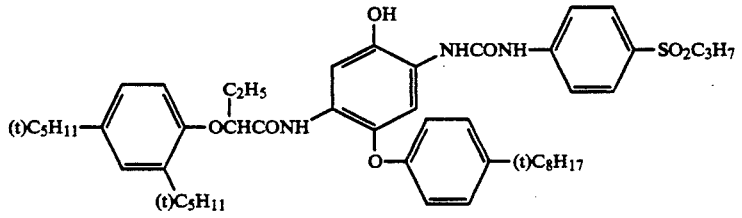
(C-34)
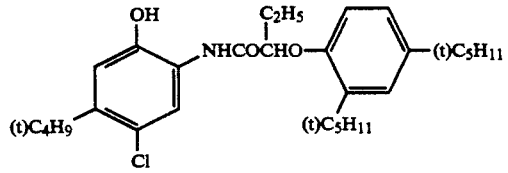
(C-35)
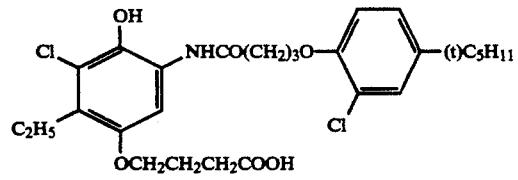
(C-36)
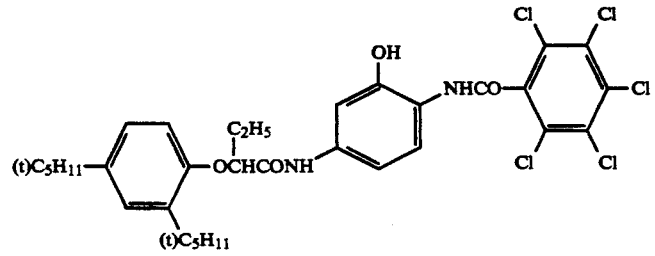

-continued
(C-37)
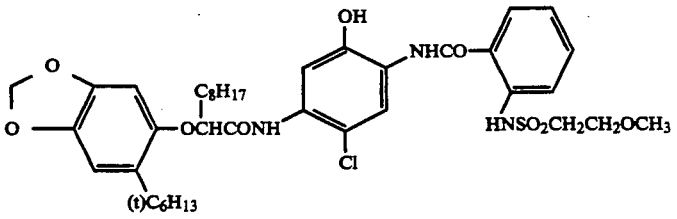
(C-38)
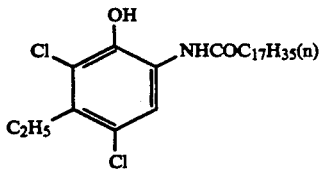
(C-39)
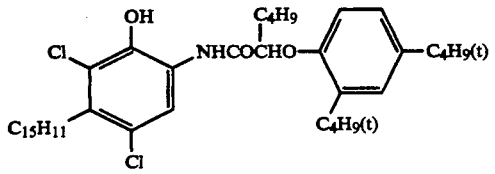
(C-40)
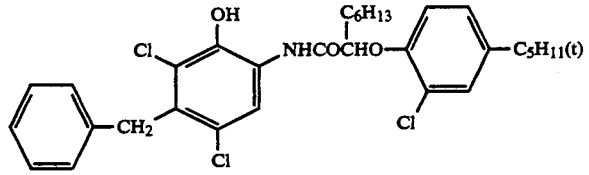
(C-41)
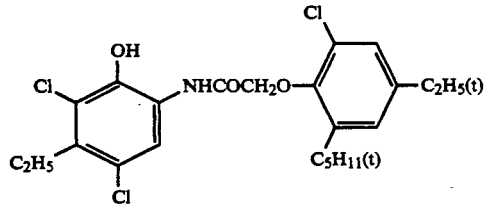
(C-42)
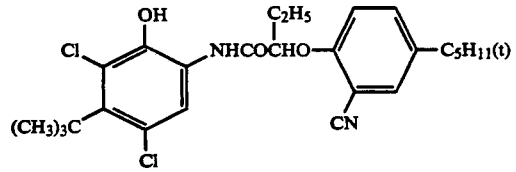
(C-43)
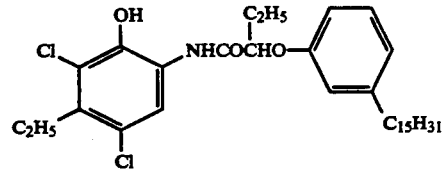
(C-44)
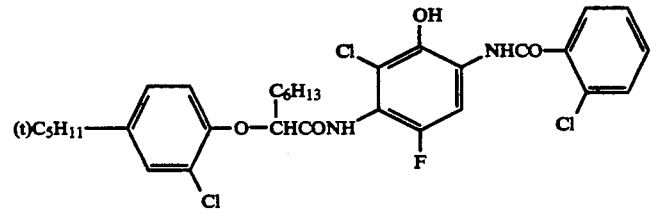

-continued
(C-45)
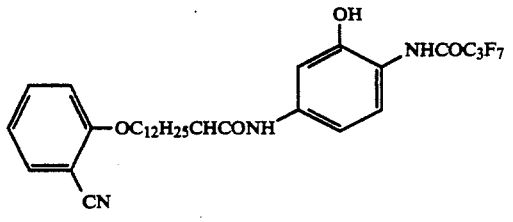
(C-46)
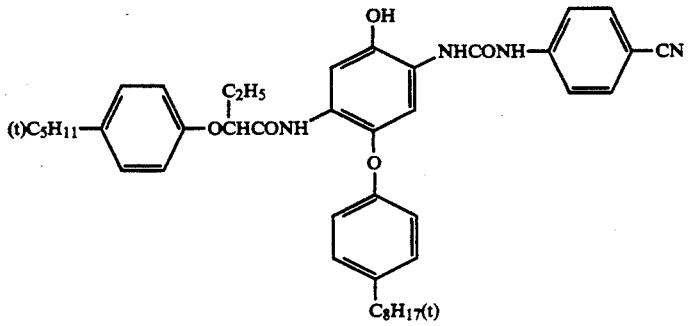
(C-47)
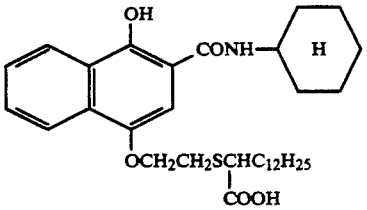
(C-48)
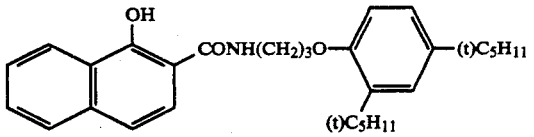
(C-49)
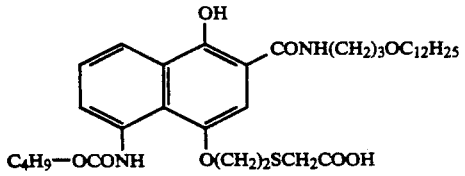
(C-50)
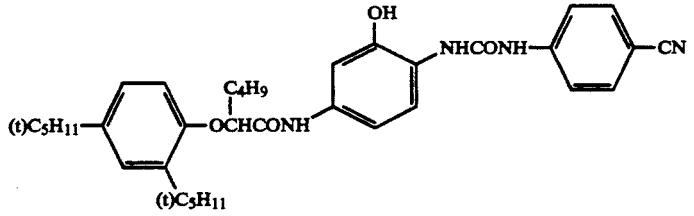
(C-51)
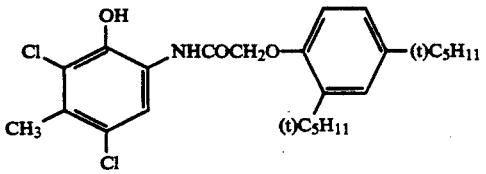

-continued
(C-52)
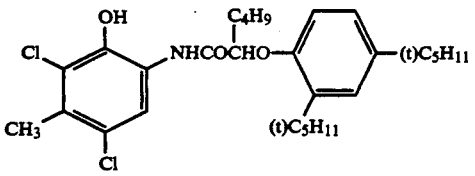
As well as the cyan couplers of the type represented by the general formula (I), use can be made of the diphenylimidazole cyan couplers disclosed in European Patent Application (Laid Open) 0,249,453A2.
(C-53)
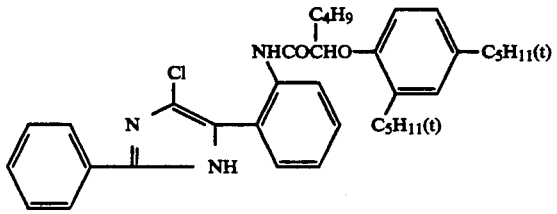
(C-54)
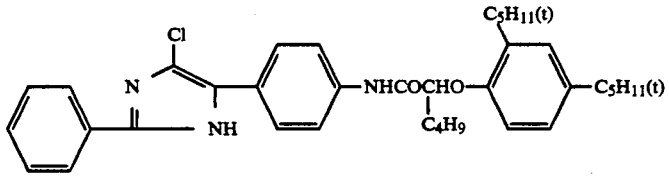
(C-55)
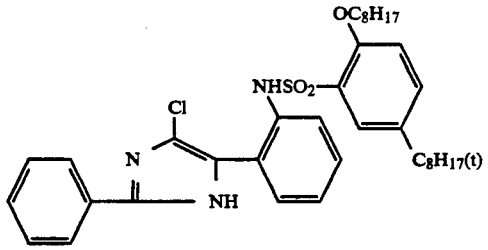
(C-56)
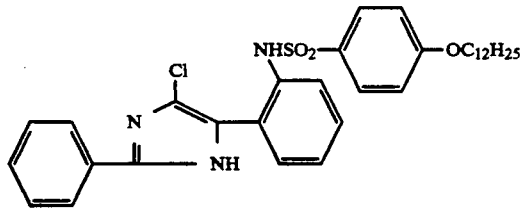
(C-57)
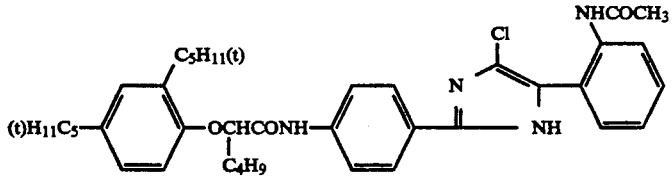

-continued (C-58)

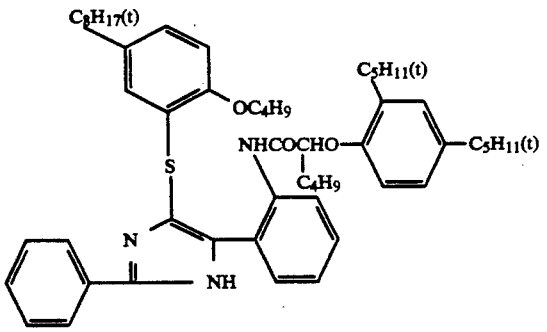

The methods for synthesizing the cyan couplers which can be used in the invention are described, for example, in Canadian Patent 625,822, U.S. Pat. Nos. 3,772,002, 4,564,590, 2,895,826, 4,557,999, 4,565,777, 4,124,396, 4,613,564, 4,327,173, 4,564,586 and 4,430,423 and JP-A-61-39045 and JP-A-62-70846.

The cyan coupler of the present invention is preferably used in an amount of from $1\times10^3$ to about 1 mol, more preferably from 0.1 to 0.5 mol, per mol of silver halide.

The color sensitive materials of the present invention may contain yellow couplers and magenta couplers in addition to cyan couplers.

The use of the pivaloylacetanilide based couplers disclosed, for example, in U.S. Pat. Nos. 4,622,287 and 4,623,616 and the benzoylacetanilide based couplers disclosed, for example, in U.S. Pat. Nos. 3,408,194, 3,933,501, 4,046,575, 4,133,958 and 4,401,752 as yellow couplers is preferred, and of these the former are more preferred from the point of view of the fastness of the colored image. Furthermore, these couplers which have a nitrogen elimination type coupling-off group are most preferred from the viewpoint of their high activity (good color forming properties).

Furthermore, the use of 3-anilino-5-pyrazolone based couplers, 3-acylamino-5-pyrazolone based couplers and pyrazolotriazole based couplers as magenta couplers is preferred.

From among the pyrazoloazole based couplers, the imidazo[1,2-b]pyrazoles disclosed in U.S. Pat. No. 4,500,630 are preferred from the viewpoint of their low absorbance on the yellow side and the light fastness of the colored dye, and the pyrazolo[1,5-b][1,2,4]triazoles disclosed in U.S. Pat. No. 4,540,654 are especially preferred.

Moreover, the use of the pyrazolotriazole couplers in which a branched alkyl group is bonded directly to the 2-, 3- or 6-position of the, pyrazolotriazole ring, such as those disclosed in JP-A-61-65245, the pyrazoloazole couplers which contain a sulfonamido group within the molecule, such as those disclosed in JP-A-61-65246, the pyrazoloazole couplers which have alkoxyphenylsulfonamido ballast groups, such as those disclosed in JP-A-61-147254, and the pyrazolotriazole couplers which have alkoxy groups or aryloxy groups in the 6-position, such as those disclosed in European Patent Application (Laid Open) 226,849, is preferred.

Specific examples of oil-soluble magenta and yellow couplers which can be used in the invention are tabulated below, but the present invention is not to be construed as being limited to these examples.

| Compound | $R_{33}$ | $R_{34}$ | $X_2$ |
|---|---|---|---|
| | | 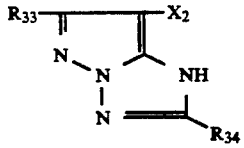 | |
| M-1 | $CH_3$— | 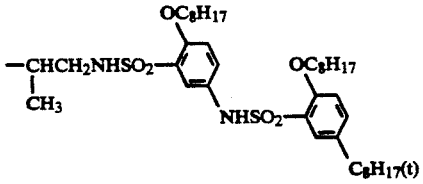 | Cl |
| M-2 | As above | 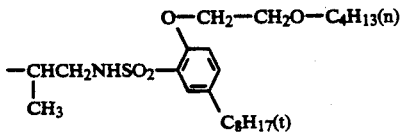 | As above |

-continued
| Compound | $R_{33}$ | $R_{34}$ | $X_2$ |
|---|---|---|---|
| M-3 | As above | 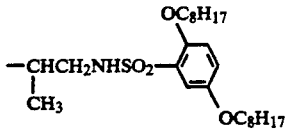 | 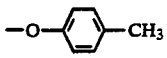 |
| M-4 | 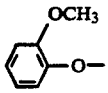 | 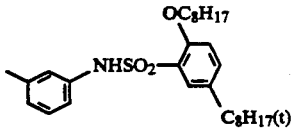 | 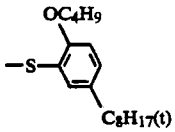 |
| M-5 | $CH_3$— | 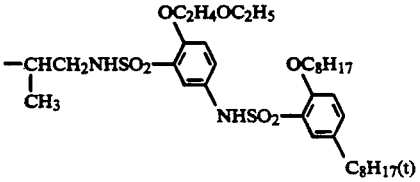 | Cl |
| M-6 | As above | 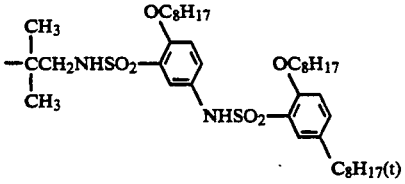 | As above |
| M-7 | 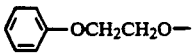 | 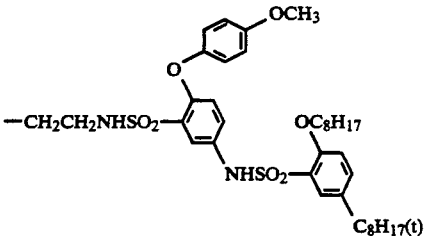 | 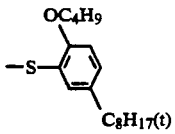 |
| M-8 | $CH_3CH_2O$— | As above | As above |
| M-9 | 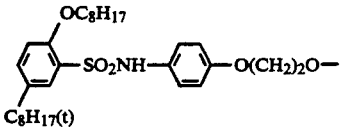 | 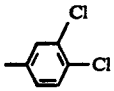 | As above |
| M-10 | 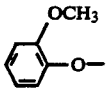 | 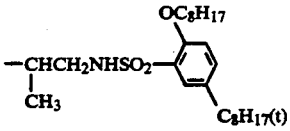 | Cl |
| | | 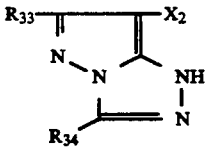 | |
| M-11 | $CH_3$— | 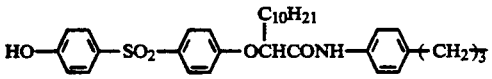 | Cl |
| M-12 | as above | 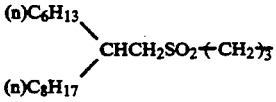 | As above |

-continued
| Compound | $R_{33}$ | $R_{34}$ | $X_2$ |
|---|---|---|---|
| M-13 | $(CH_3)_2CH-$ | $OC_4H_9$, $-SO_2-(CH_2)_3-$, $C_8H_{17}(t)$ | As above |
| M-14 | $-(CH(COOCH_2CH_2OCH_3)-CH_2)_{50}-(CH_2-C(CH_3)(CONH))_{50}-$ | $CH_3-CH(CH_2NHSO_2CH_3)-$ | As above |
| M-15 | $-O-$ | $OC_8H_{17}$, $-(CH_2)_2NHSO_2-$, $C_8H_{17}(t)$ | Cl |
| M-16 | Cl, $-O-$ | $OC_8H_{17}$, $-(CH_2)_2NHSO_2-$, $C_8H_{17}(t)$ | $OC_4H_9$, $-S-$, $C_8H_{17}(t)$ |
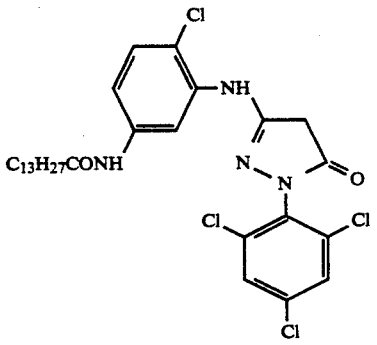
(M-17)
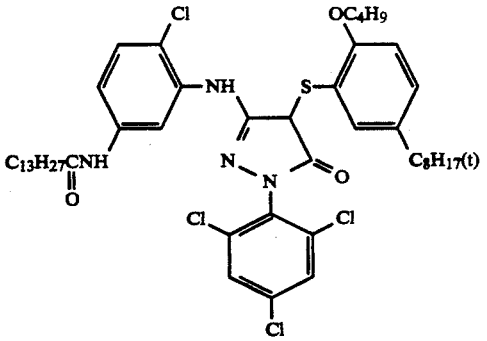
(M-18)

-continued
(M-19)
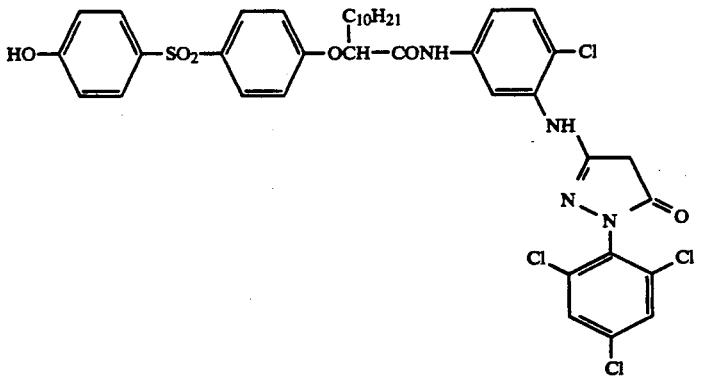
(M-20)
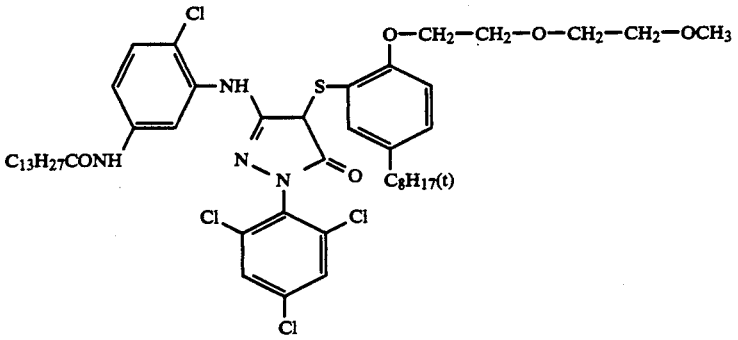
(M-21)
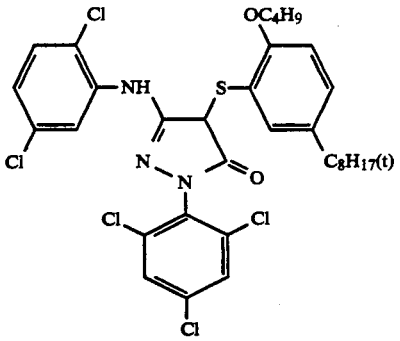
(M-22)
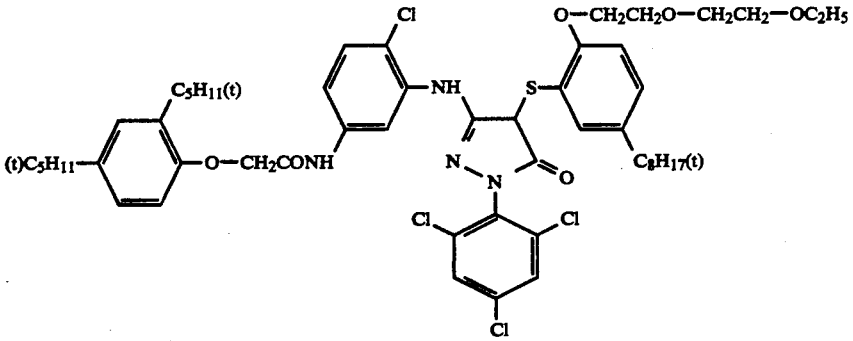

-continued
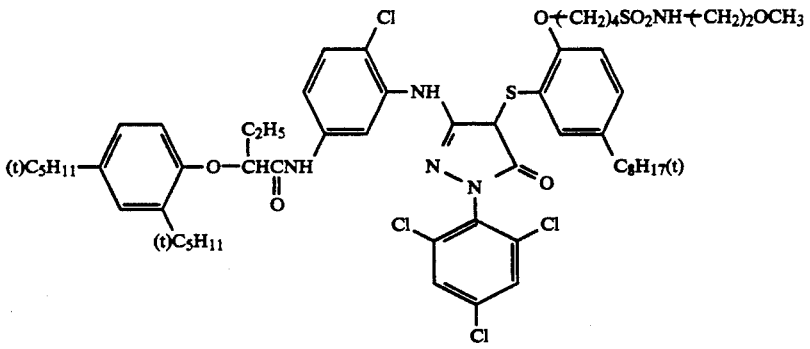
(M-23)
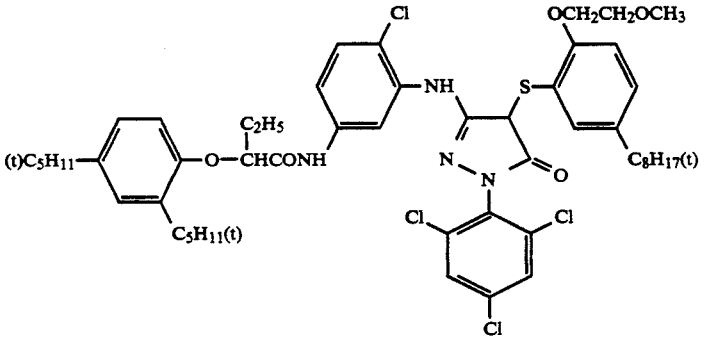
(M-24)
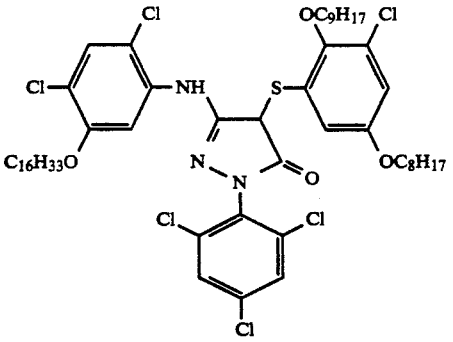
(M-25)
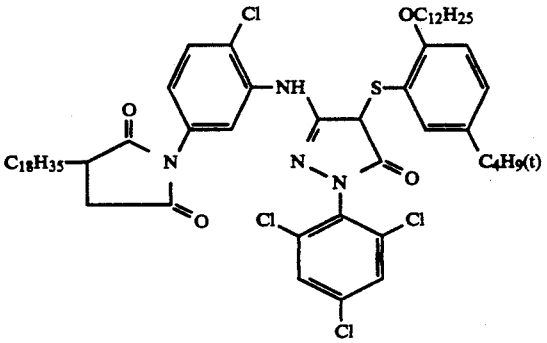
(M-26)

-continued
(M-27)
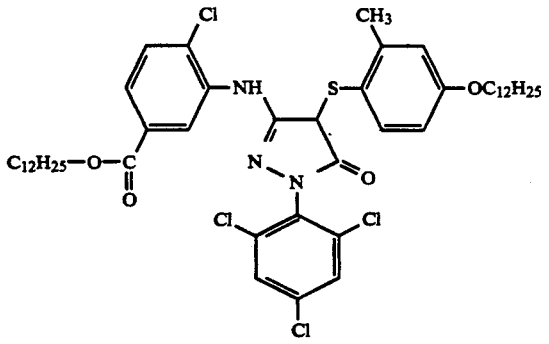
(M-28)
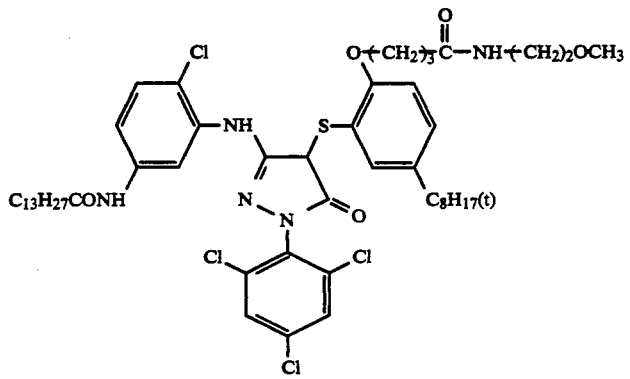
(M-29)
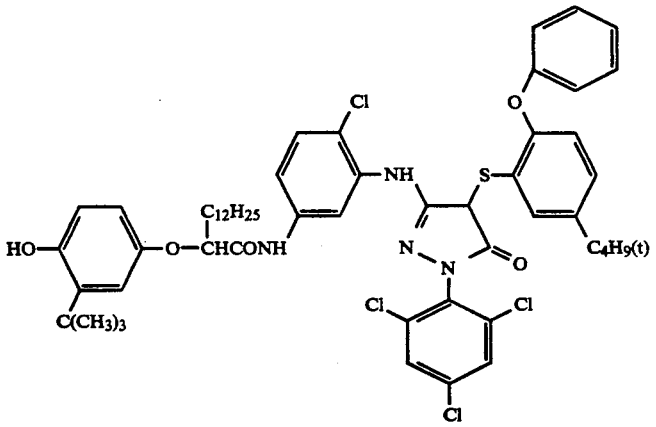
(M-30)
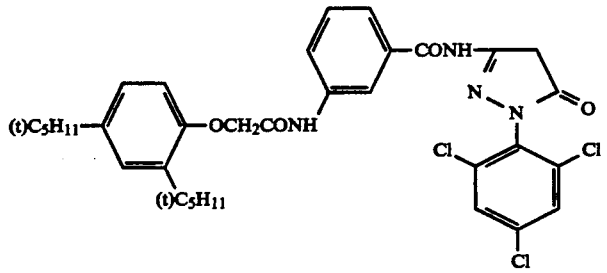

-continued
(M-31)
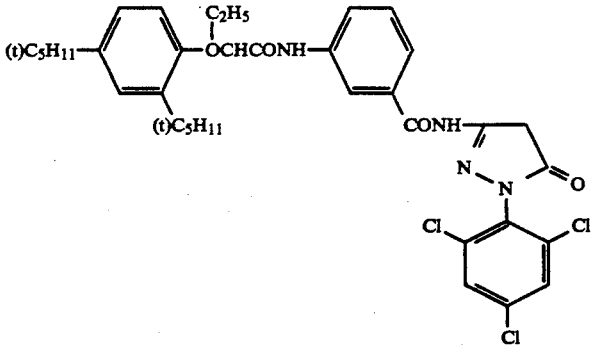
(M-32)
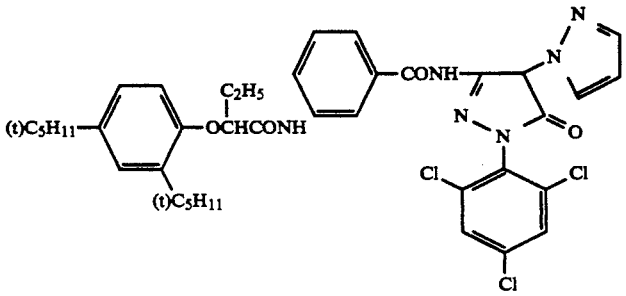
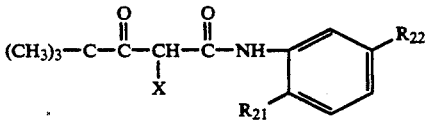
| Compound | $R_{22}$ | X | $R_{21}$ |
|---|---|---|---|
| Y-1 | $-COOCH(CH_3)COOC_{12}H_{25}$ | 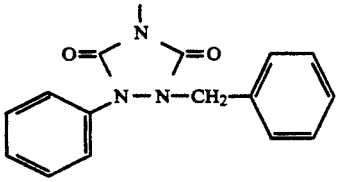 | Cl |
| Y-2 | $-COOCH(C_4H_9)COOC_{12}H_{25}$ | As above | Cl |
| Y-3 | 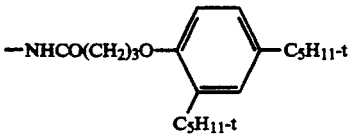 | 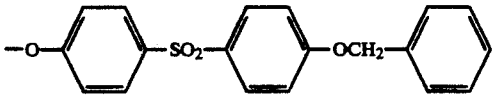 | Cl |
| Y-4 | As above | 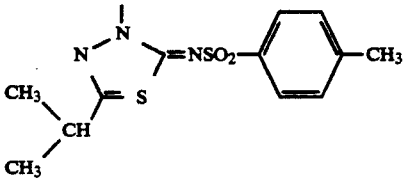 | Cl |

-continued
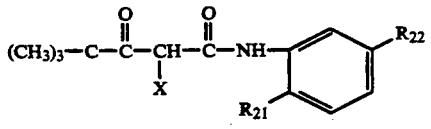
| Compound | $R_{22}$ | X | $R_{21}$ |
|---|---|---|---|
| Y-5 | 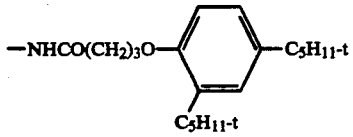 | 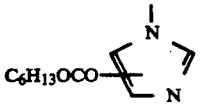 | Cl |
| Y-6 | $-NHSO_2C_{12}H_{25}$ | 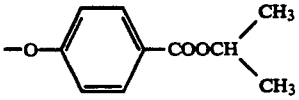 | Cl |
| Y-7 | $-NHSO_2C_{16}H_{33}$ | 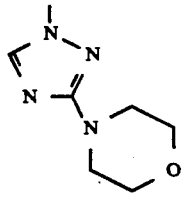 | Cl |
| Y-8 | $-COOC_{12}H_{25}(n)$ | 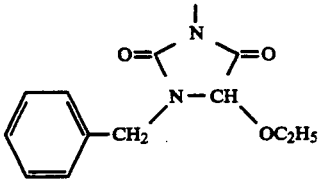 | Cl |
| Y-9 | 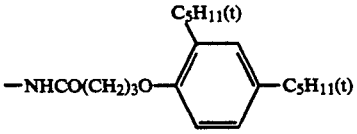 | 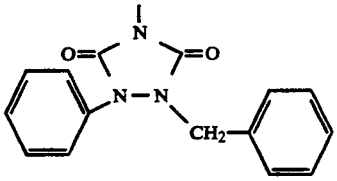 | Cl |
| Y-10 | 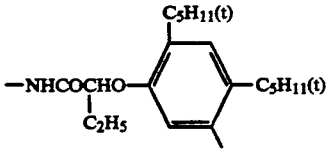 | 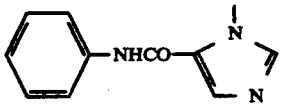 | $OCH_3$ |
| Y-11 | 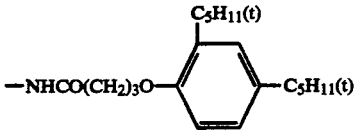 | 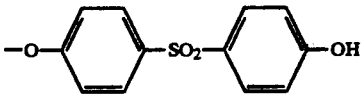 | Cl |
| Y-12 | 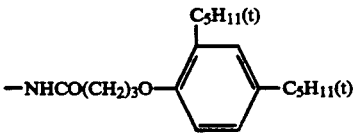 | 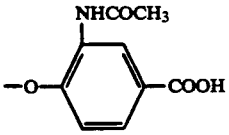 | Cl |

-continued
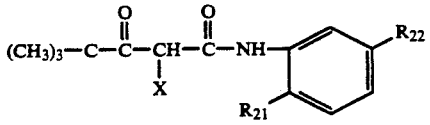
| Compound | $R_{22}$ | X | $R_{21}$ |
|---|---|---|---|
| Y-13 | 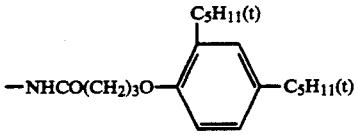 | 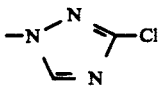 | Cl |
| Y-14 | 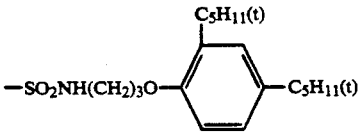 | 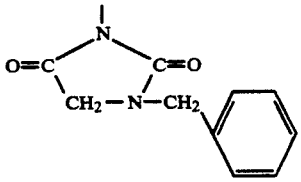 | Cl |
| Y-15 | 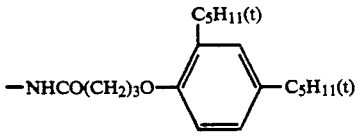 | 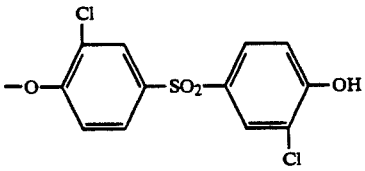 | Cl |
| Y-16 | 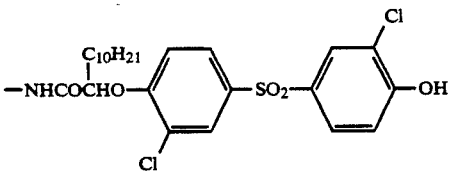 | 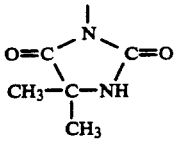 | Cl |
| Y-17 | 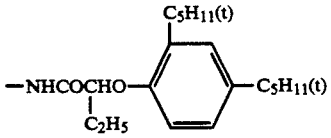 | 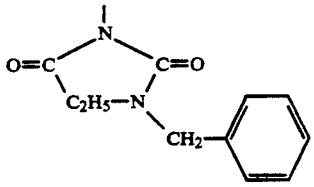 | Cl |
| Y-18 | 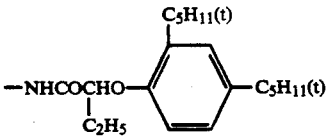 | 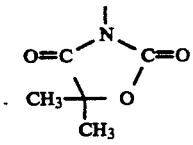 | Cl |
| Y-19 | $-NHSO_2C_{16}H_{33}$ | 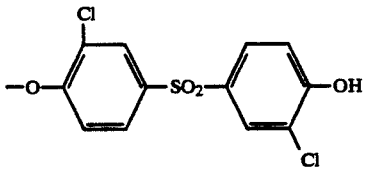 | Cl |
| Y-20 | 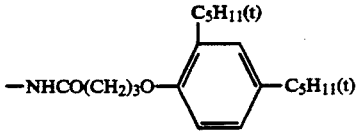 | 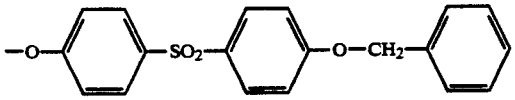 | Cl |

-continued
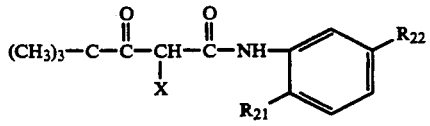
| Compound | $R_{22}$ | X | $R_{21}$ |
|---|---|---|---|
| Y-21 | 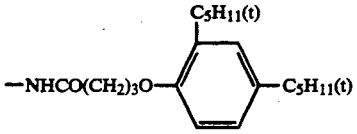 | 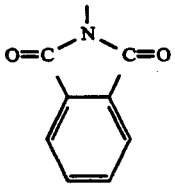 | Cl |
| Y-22 | 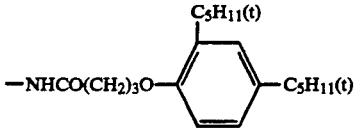 | 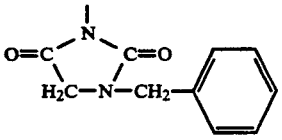 | Cl |
| Y-23 | 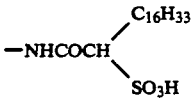 | 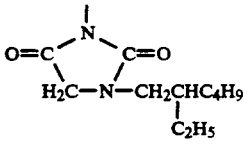 | Cl |
| Y-24 | 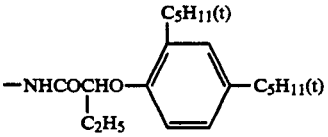 | 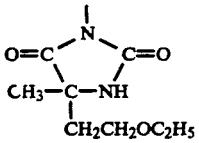 | Cl |
| Y-25 | $-NHCOCHCH_2SO_2C_{12}H_{25}(n)$ <br> $CH_3$ | 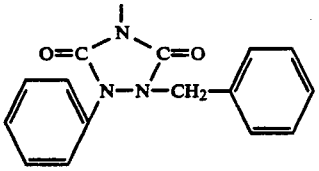 | Cl |
| Y-26 | $-NHSO_2C_{16}H_{33}(n)$ | 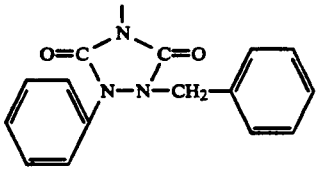 | Cl |
| Y-27 | 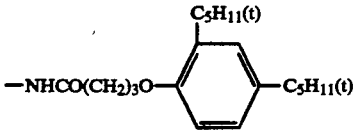 | 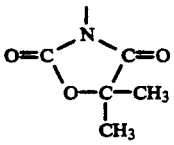 | Cl |
| Y-28 | As above | 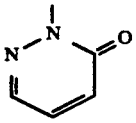 | Cl |

-continued

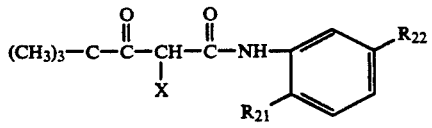

| Compound | $R_{22}$ | X | $R_{21}$ |
|---|---|---|---|
| Y-29 | As above | 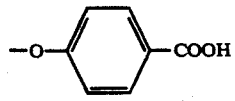 | Cl |
| Y-30 | $-NHSO_2-C_{16}H_{33}(n)$ | 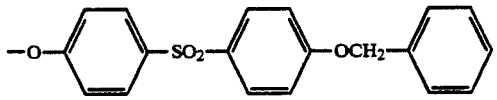 | Cl |
| Y-31 | As above | 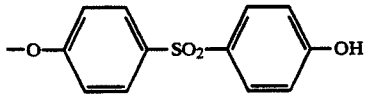 | Cl |
| Y-32 | $-SO_2-NHCH_3$ | 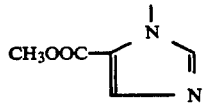 | $-OC_6H_{13}$ |
| Y-33 | 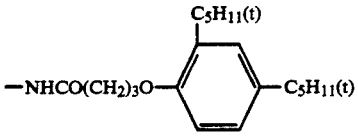 | 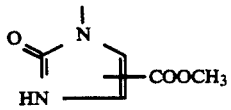 | Cl |
| Y-34 | 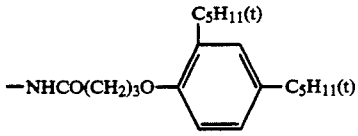 | 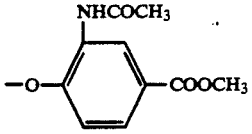 | Cl |
| Y-35 | 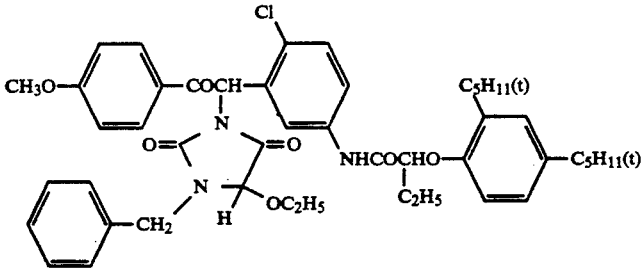 | | Cl |

The high boiling point organic solvents having a viscosity of at least 500 cp (25° C.) and having a boiling point of at least 120° C. which can be used in the invention are described below.

The high boiling point organic solvents are preferably selected from among the compounds represented by formulae (II), (III), (IV), (V), (VI), or (VII) indicated below.

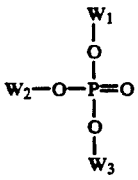

(II)

$W_1-COOW_2$ (III)

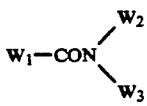

(IV)

-continued

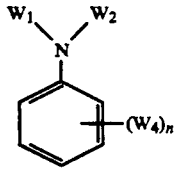

(V)

$W_1—O—W_2$ (VI)

$W_5—X$ (VII)

wherein $W_1$, $W_2$ and $W_3$, which may be the same or different, each represents a substituted or unsubstituted alkyl, cycloalkyl, alkenyl, aryl or heterocyclic group; $W_4$ represents $W_1—O—W_1$ or $—S—W_1$; and n is an integer of 1 to 5, and when n has a value of 2 or more the $W_4$ groups may be the same or different. Moreover, $W_1$ and $W_2$ in general formula (VI) may be linked to form a condensed ring.

$W_5$ represents a substituted or unsubstituted alkyl, cycloalkyl or aryl group, and the number of carbon atoms in the $W_5$ group is at least 12. X represents a halogen atom.

When $W_1$, $W_2$, $W_3$ and $W_5$ groups have substituent groups, these substituent groups are preferably groups which have one or two linking groups selected from

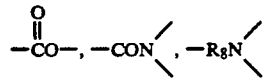

(where $R_8$ represents a 2- to 6-valent phenyl group which is derived from a phenyl group by removing hydrogen atoms therefrom) and —O—.

The alkyl groups represented by $W_1$, $W_2$, $W_3$, $W_4$ and $W_5$ may be linear chain or branched chain alkyl groups. Examples of such groups include methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl and eicosyl groups.

The substituent groups for these alkyl groups may be, for example, halogen atoms, cycloalkyl groups, aryl groups or ester groups. Examples of such substituted alkyl groups with halogen (F, Cl, Br) substituents include $—C_2HF_4$, $—C_5H_3F_8$, $—C_9H_3F_{16}$, $—C_2H_4Cl$, $—C_3H_6Cl$, $—C_3H_5C_2$, $—C_3H_5ClBr$ and $—C_3H_5Br_2$. Examples of such substituted alkyl groups with cycloalkyl substituent groups include

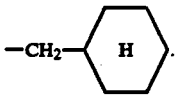

Examples of such alkyl groups which have aryl substituent groups include

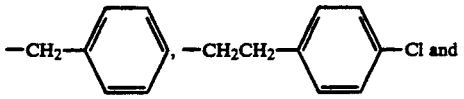

-continued

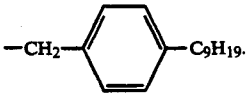

Examples of such substituted alkyl groups with substituents which provide dibasic esters include

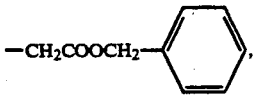

$—CH_2CH_2COOC_{12}H_{25}$, $—(CH_2)_4COOC_{10}H_{21}$, $—(CH_2)_4COOCH_2(CF_2CF_2)_2H$, $—(CH_2)_7COOC_4H_9$ and $—(CH_2)_8COOC_{12}H_{25}$. Examples of such substituted alkyl groups with substituents which provide lactic acid esters include

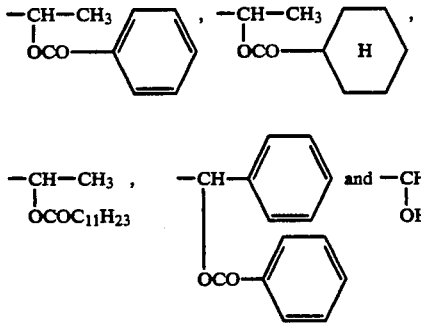

Examples of such alkyl groups with substituent groups which provide citrate esters include

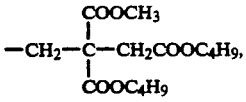

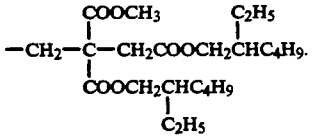

Examples of such substituted alkyl groups which give malate esters include $—CH_2CH(OH)COOC_6H_{13}$ and $—CH_2CH(OH)COOC_{12}H_{25}$. Examples of such substituted alkyl groups which provide tartrate esters include $—CH(OH)CH(OH)COOC_8H_{17}$, $—CH(OH)CH(OH)COOC_{18}H_{37}$, and

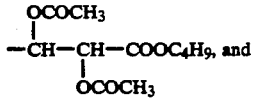

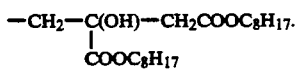

Moreover, $W_1$ and $W_2$ in general formula (VI) may include an oxylane, oxolane or oxane ring which forms a condensed ring.

The cycloalkyl groups represented by $W_1$, $W_2$, $W_3$, $W_4$ or $W_5$ are, for example,

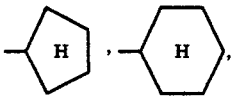

and examples of substituted cycloalkyl groups include

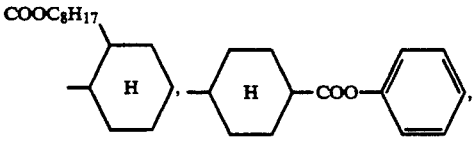

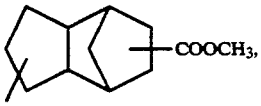

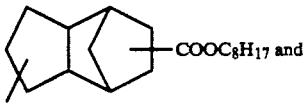

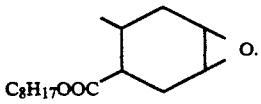

Examples of the aryl groups represented by $W_1$, $W_2$, $W_3$, $W_4$ or $W_5$ include

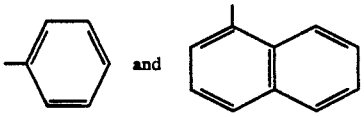

and examples of substituted aryl groups include

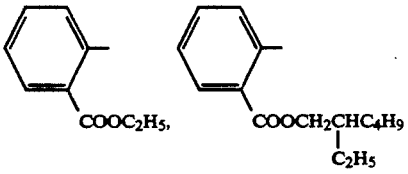

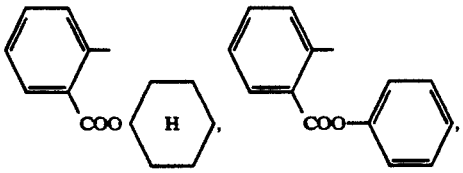

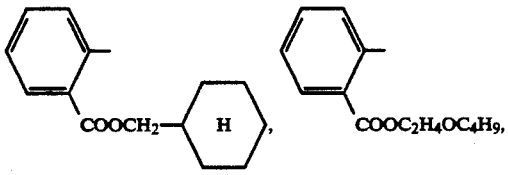

-continued

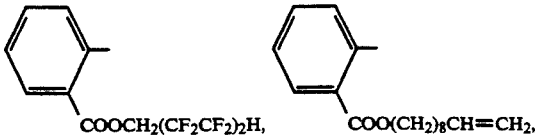

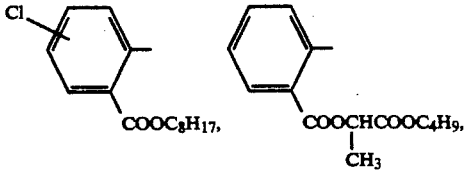

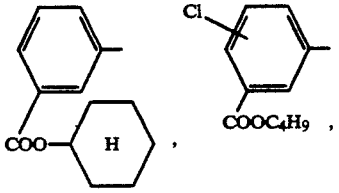

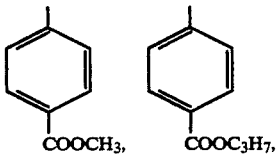

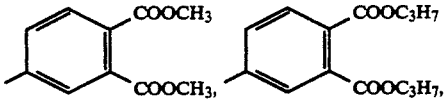

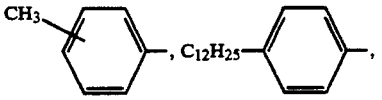

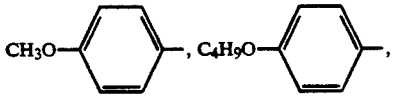

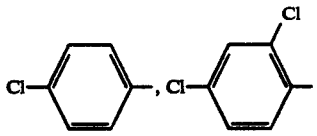

Examples of alkenyl groups include $-C_4H_7$, $-C_5H_9$, $C_6H_{11}$, $-C_7H_{13}$, $-C_8H_{15}$, $-C_{10}H_{19}$, $-C_{12}H_{23}$ and $-C_{18}H_{35}$, and examples of substituted alkenyl groups include groups such as

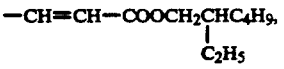

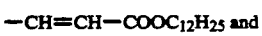

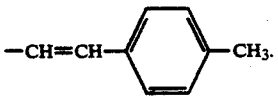

which have substituent groups such as halogen atoms (F, Cl, Br),

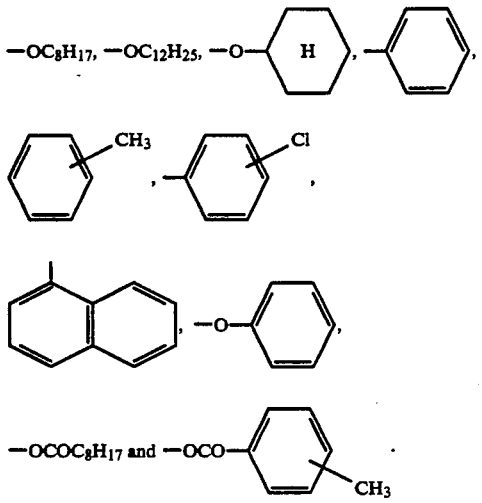

The boiling point of high boiling point organic solvents used in the invention is preferably at least 140° C., and most desirably at least 160° C. The total number of carbon atoms in the aforementioned groups $W_1$ to $W_4$ in these compounds is preferably at least 8, these being alkyl groups.

The term "organic solvent" generally suggests that the material is itself a liquid, but in the present invention the organic solvents of which the viscosity measured at 25° C. is at least 500 cp include solids, and they are selected from compounds represented by formulae (II) to (VIII) which preferably have a viscosity of at least 700 cp or which, most desirably, are solid with a melting point of at least 25° C. Of these compounds, those represented by formulae (II) and (III) are preferred, and the dialkyl (secondary and tertiary alkyl) or dicycloalkyl esters of phthalic acid or phosphoric acid are especially desirable. Dicycloalkyl esters of phthalic acid are the most desirable. The viscosities can be measured using a cone plate type rotary viscometer (Visconisemd, made by Tokyo Keiki).

The amounts of the above-mentioned high boiling point organic solvents used can be varied appropriately according to the type and amount of cyan coupler used, but a ratio (by weight) of high boiling point solvent to cyan coupler in the range from 0.05 to 20 is preferred.

The high boiling point solvents of this invention can be used individually or in the form of mixtures, or they can be used in the form of mixtures with other conventional high boiling point organic solvents. Examples of such high boiling point organic solvents include phosphate ester based solvents such as tricresyl phosphate, tri-2-ethylhexyl phosphate, 7-methyloctyl phosphate and tricyclohexyl phosphate, and phenol based solvents such as 2,5-di-tert-amylphenol and 2,5-di-sec-amylphenol.

Specific examples of high viscosity high boiling point organic solvents which can be used in the invention are indicated below, but the present invention is not to be construed as being limited thereto.

| COMPOUND NUMBER | STRUCTURE | REMARKS |
|---|---|---|
| S-1 | 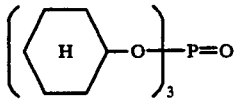 | solid (melting point 60° C.) |
| S-2 | $(ClCH_2\underset{\underset{Cl}{\vert}}{C}HCH_2O)_3P{=}O$ | solid (melting point 26.8° C.) |
| S-3 | 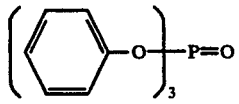 | solid (melting point 48.5° C.) |
| S-4 | 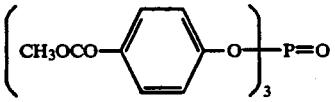 | solid (melting point 101–103° C.) |
| S-5 | 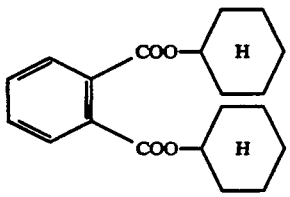 | solid (melting point 58–65° C.) |

-continued
| COMPOUND NUMBER | STRUCTURE | REMARKS |
|---|---|---|
| S-6 | 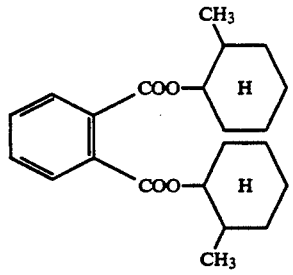 | solid |
| S-7 | 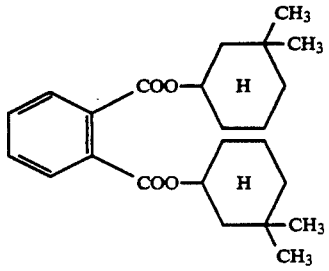 | solid |
| S-8 | 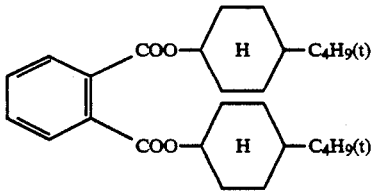 | solid |
| S-9 | 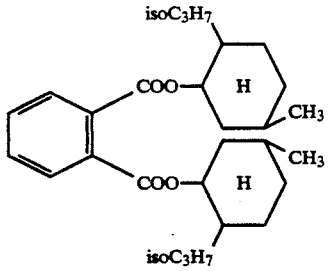 | solid (melting point 129–130° C.) |
| S-10 | 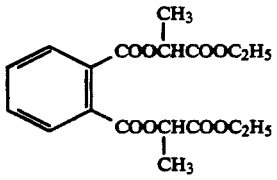 | solid (melting point 50–53° C.) |
| S-11 | 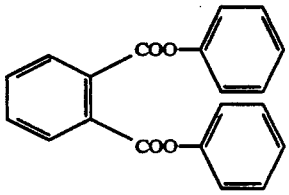 | solid (melting point 69° C.) |

-continued
| COMPOUND NUMBER | STRUCTURE | REMARKS |
|---|---|---|
| S-12 | 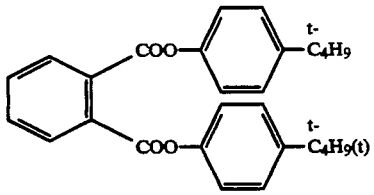 | solid (melting point 142° C.) |
| S-13 | 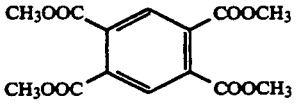 | solid (melting point 144° C.) |
| S-14 | 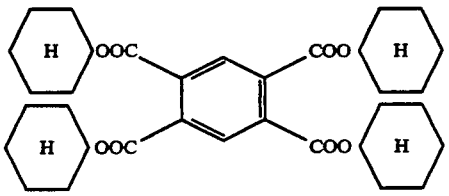 | solid (melting point 148° C.) |
| S-15 | 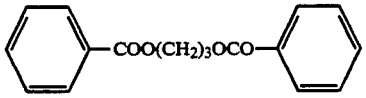 | solid (melting point 47° C.) |
| S-16 | 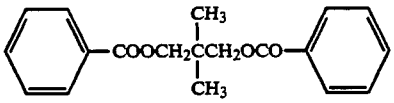 | solid (melting point 49° C.) |
| S-17 | 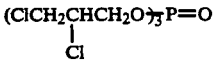 | 1500 cp |
| S-18 | 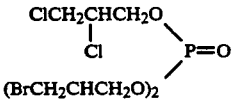 | 4260 cp |
| S-19 | 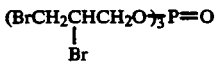 | 6810 cp |
| S-20 | 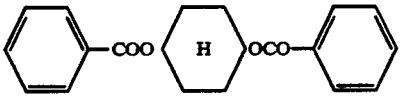 | solid (melting point 113° C.) |
| S-21 | 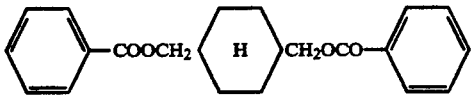 | solid (melting point 124° C.) |
| S-22 | 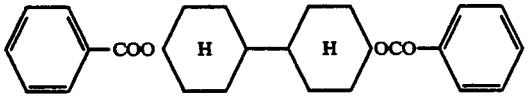 | solid (melting point 194° C.) |

-continued

| COMPOUND NUMBER | STRUCTURE | REMARKS |
|---|---|---|
| S-23 | 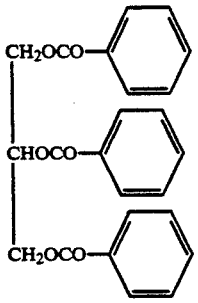 | solid (melting point 71° C.) |
| S-24 | 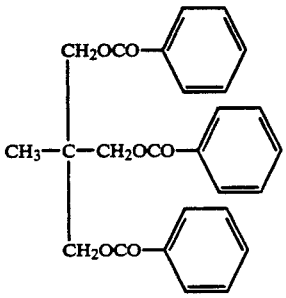 | solid (melting point 81° C.) |
| S-25 | 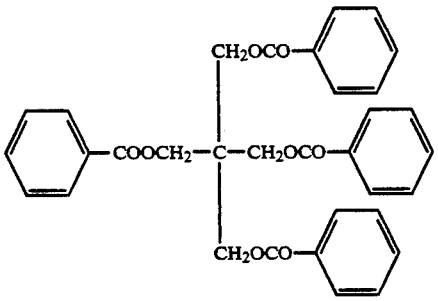 | solid (melting point 99° C.) |
| S-26 | 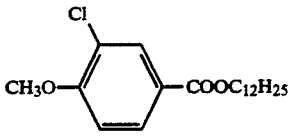 | solid (melting point 43° C.) |
| S-27 | $C_{15}H_{31}COOC_{18}H_{37}$ | solid (melting point 58° C.) |
| S-28 | $n\text{-}C_{17}H_{35}COOCH_3$ | solid (melting point 38° C.) |
| S-29 | $C_{17}H_{35}COOC_{16}H_{33}$ | solid (melting point 58° C.) |
| S-30 | $CH_2OCOC_{11}H_{23}\text{-}n$<br>\|<br>$CHOCOC_{11}H_{23}\text{-}n$<br>\|<br>$CH_2OCOC_{11}H_{23}\text{-}n$ | solid (melting point 47° C.) |
| S-31 | 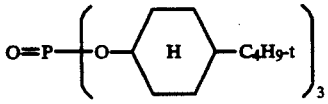 | solid |
| S-32 | $O{=}P{-}(OC_{14}H_{29})_3$ | solid |
| S-33 | $O{=}P{-}(OC_{16}H_{33})_3$ | solid |

-continued
| COMPOUND NUMBER | STRUCTURE | REMARKS |
|---|---|---|
| S-34 | 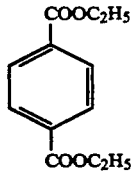 | solid |
| S-35 | 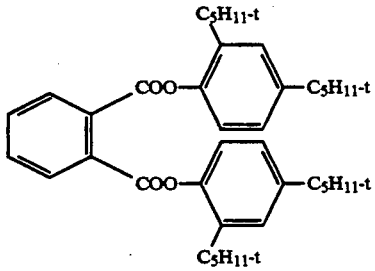 | solid |
| S-36 | 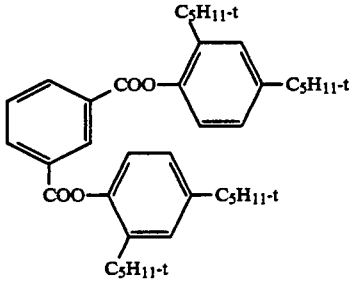 | solid |
| S-37 | 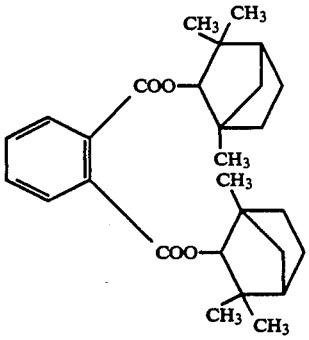 | solid |
| S-38 | 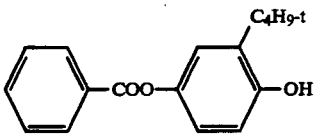 | solid |
| S-39 | 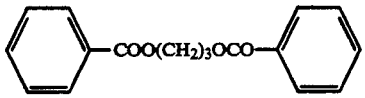 | solid |
| S-40 | 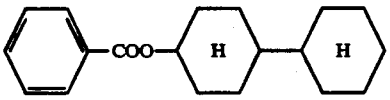 | solid |
| S-41 | 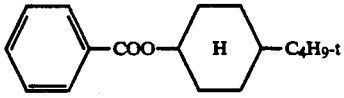 | solid |

-continued
| COMPOUND NUMBER | STRUCTURE | REMARKS |
|---|---|---|
| S-42 | 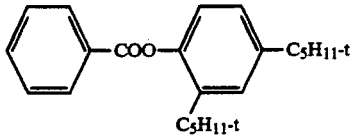 | solid |
| S-43 | 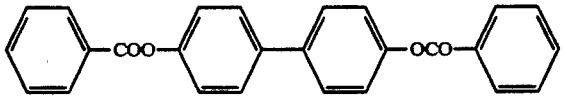 | solid |
| S-44 | 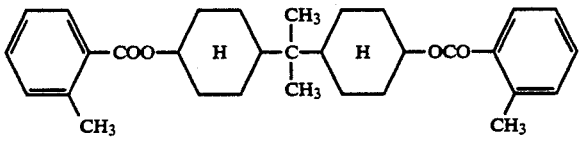 | solid |
| S-45 | 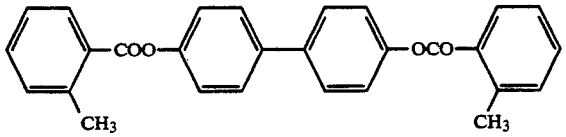 | solid |
| S-46 | 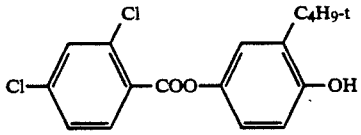 | solid |
| S-47 | 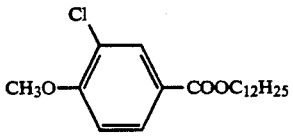 | solid |
| S-48 | $C_{15}H_{31}COOC_{16}H_{33}$ | solid |
| S-49 | $CH_2OCOC_{17}H_{35}$<br>\|<br>$CHOCOC_{17}H_{35}$<br>\|<br>$CH_2OCOC_{17}H_{35}$ | solid |
| S-50 | $C_8H_{17}CH{=}CH(CH_2)_7\ CONH_2$ | solid |
| S-51 | 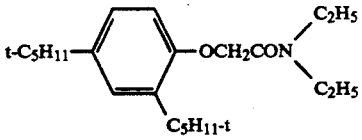 | solid |
| S-52 | 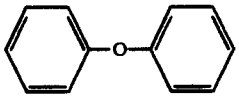 | solid |
| S-53 | 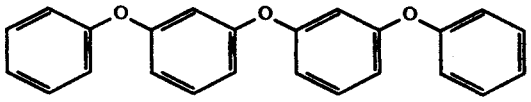 | solid |
| S-54 | 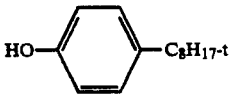 | solid |

-continued

| COMPOUND NUMBER | STRUCTURE | REMARKS |
|---|---|---|
| S-55 | 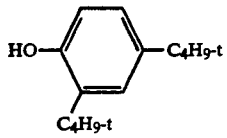 | solid |
| S-56 | $C_{24}H_{29}Cl_{21}$chlorinated paraffin | solid |
| S-57 | 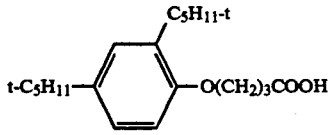 | solid |
| S-58 | 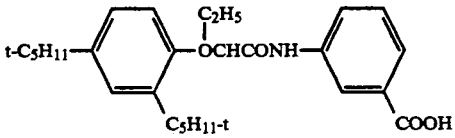 | solid |
| S-59 | 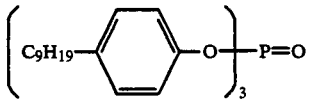 | 15,600 cp |
| S-60 | 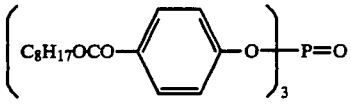 | 20,800 cp |
| S-61 | 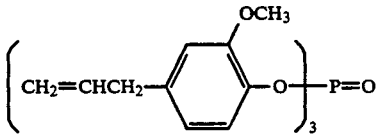 | 21,600 cp |
| S-62 | 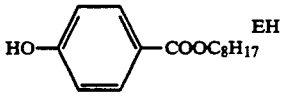 | 14,300 cp |
| S-63 | 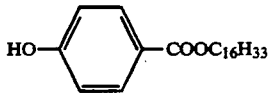 | solid |

The preferred polymers for use in silver halide photographic photosensitive materials of this invention are polymers which have a relative fluorescence yield K value of at least 0.10 and preferably of at least 0.20. The larger this value more preferred the polymer.

The term K value as used herein is the relative fluorescence quantum yield in the polymer of the compound A of which the structural formula is shown below, this being a type of dye which is widely used as a fluorescence probe.

Compound A

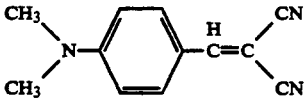

-continued $$K = \phi a/\phi b$$

$$K=\phi a/\phi b$$

Here, $\phi a$ and $\phi b$ are the fluorescence quantum yields of the compound A in each of the polymers a and b, and they are determined, for example, using the method described in *Macromolecules*, 14, 587 (1981). In practice, the value is obtained by calculation from $\phi a$ and $\phi b$ measured at room temperature using thin polymer films with concentrations of 0.5 mM of the aforementioned compound. The film is spin coated onto a slide glass to a thickness such that the optical density at $\lambda_{max}$ of the absorbance of compound A is from 0.05 to 0.1. Furthermore, in the present invention, the K values used are those obtained using poly(methyl methacrylate) (number average molecular weight 20,000) for the above-mentioned polymer b.

Specific examples of polymers which can be used in the invention are described below, but the invention is not to be construed as being limited to the use of these examples.

(A) Vinyl Polymers

Monomers which can be used to form vinyl polymers of this invention include acrylic acid esters, including methyl acrylate, ethyl acrylate, n-propyl acrylate, isopropyl acrylate, n-butyl acrylate, isobutyl acrylate, sec-butyl acrylate, tert-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-isopropoxy acrylate, 2-butoxyethyl acrylate, 2-(2-methoxyethoxy)ethyl acrylate, 2-(2-butoxyethoxy)ethyl acrylate, ω-methoxypolyethylene glycol acrylate (number of mols addition n=9), 1-bromo-2-methoxyethyl acrylate and 1,1-dichloro-2-ethoxyethyl acrylate. The monomers indicated below, for example, can also be used.

Methacrylic acid esters: examples include methyl methacrylate, ethyl methacrylate, n-propyl methacrylate, isopropyl methacrylate, n-butyl methacrylate, isobutyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, sulfopropyl methacrylate, N-ethyl-N-phenylaminoethyl methacrylate, 2-(3-phenylpropyloxy)ethyl methacrylate, diethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylene glycol monomethacrylate, dipropylene glycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-isopropoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxypolyethylene glycol methacrylate (number of mols addition n=6), allyl methacrylate and methacrylic acid dimethylaminoethylmethyl chloride.

Vinyl esters: examples include vinyl acetate, vinyl propionate, vinyl butyrate, vinyl isobutyrate, vinyl caproate, vinyl chloroacetate, vinyl methoxyacetate, vinyl phenylacetate, vinyl benzoate and vinyl salicylate.

Acrylamides: for example, acrylamide, methylacrylamide, ethylacrylamide, propylacrylamide, butylacrylamide, tert-butylacrylamide, cyclohexylacrylamide, benzylacrylamide, hydroxymethylacrylamide, methoxyethyl- acrylamide, dimethylaminoethylacrylamide, phenylacrylamide, dimethylacrylamide, diethylacrylamide, β-cyanoethylacrylamide, N-(2-acetoacetoxyethyl)acrylamide, diacetoneacrylamide and tert-octylacrylamide.

Methacrylamides: for example, methacrylamide, methylmethacrylamide, ethylmethacrylamide, propylmethacrylamide, butylmethacrylamide, tert-butylmethacrylamide, cyclohexylmethacrylamide, benzylmethacrylamide, hydroxymethylmethacrylamide, methoxyethylmethacrylamide, dimethylaminoethylmethacrylamide, phenylmethacrylamide, dimethylmethacrylamide, diethylmethacrylamide, β-cyanoethylmethacrylamide and N-(2-acetoacetoxyethyl)methacrylamide.

Olefins: for example, dicyclopentadiene, ethylene, propylene, 1-butene, 1-pentene, vinyl chloride, vinylidene chloride, isoprene, chloroprene, butadiene, 2,3-dimethylbutadiene.

Styrenes: for example, styrene, methylstyrene, dimethylstyrene, trimethylstyrene, ethylstyrene, isopropylstyrene, chloromethylstyrene, methoxystyrene, acetoxystyrene, chlorostyrene, dichlorostyrene, bromostyrene and methyl vinylbenzoate.

Vinyl ethers: for example, methyl vinyl ether, butyl vinyl ether, hexyl vinyl ether, methoxyethyl vinyl ether and dimethylaminoethyl vinyl ether.

Other compounds include, for example, butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyloxazolidone, N-vinylpyrrolidone, acrylonitrile, methacrylonitrile, methylenemalonitrile and vinylidene.

Two or more of the monomers (for example, the above-mentioned monomers) which can be used in polymers of this invention can be used as comonomers for various purposes (for example, for improving solubility). Furthermore, monomers which have acid groups, such as those indicated below, can also be used as comonomers for the adjustment of solubility provided that the copolymer remains insoluble in water.

Acrylic acid; methacrylic acid; itaconic acid; maleic acid; monoalkyl itaconates, for example, monomethyl itaconate, monoethyl itaconate and monobutyl itaconate; monoalkyl maleates, for example, monomethyl maleate, monoethyl maleate and monobutyl maleate; citraconic acid; styrenesulfonic acid; vinylbenzyl sulfonic acid; vinyl sulfonic acid; acryloyloxyalkylsulfonic acid, for example, acryloyloxymethylsulfonic acid, acryloyloxyethylsulfonic acid and acryloyloxypropylsulfonic acid; methacryloyloxyalkylsulfonic acids, for example, methacryloyloxymethylsulfonic acid, methacryloyloxyethylsulfonic acid and methacryloyloxypropylsulfonic acid; acrylamidoalkylsulfonic acids, for example, 2-acrylamido-2-methylethanesulfonic acid, 2-acrylamido-2-methylpropanesulfonic acid and 2-acrylamido-2-methylbutanesulfonic acid; methacrylamidoalkylsulfonic acids, for example, 2-methacrylamido-2-methylethanesulfonic acid, 2-methacrylamido-2-methylpropanesulfonic acid and 2-methacrylamido-2-methylbutanesulfonic acid; and the alkali metal (for example, sodium or potassium) or ammonium ion salts of these acids.

In cases where a hydrophilic monomer (here, this signifies a monomer which forms a water-soluble homopolymer) is used as a comonomer with the vinyl monomers indicated above and other vinyl monomers which can be used in the invention, no particular limitation is imposed on the proportion of hydrophilic monomer which is included in the copolymer provided that the copolymer does not become water-soluble but, normally, such monomers are used in an amount not exceeding 40 mol %, preferably in an amount not exceeding 20 mol % and, most desirably, in an amount not exceeding 10 mol %. Furthermore, in cases where the hydrophilic comonomer which is copolymerized with a monomer of this invention has acid groups, the proportion in the copolymer of the comonomer which has acid groups is normally not more than 20 mol %, and preferably not more than 10 mol %, while the absence of copolymers of this type is most desirable from the point of view of the image storage properties as described earlier.

The monomers of this invention in the polymer are preferably methacrylate based, acrylate based and methacrylamide based monomers. The acrylate and methacrylate based monomers are especially desirable.

(B) Polymers Formed by Condensation and Polyaddition Reactions

Polyesters formed from polyhydric alcohols and polybasic acids, and polyamides formed from diamines and dibasic acids and from ω-amino-ω'-carboxylic acids, are generally known as condensation polymers, and polymers such as the polyurethanes which are formed from diisocyanates and dihydric alcohols are known as polymers cyanates and dihydric alcohols are known as polymers which have been formed by means of a polyaddition reaction.

Glycols which have an OH—$R_1$—OH structure (where $R_1$ is a hydrocarbon chain, especially an aliphatic hydrocarbon chain, which has from 2 to about 12 carbon atoms), or polyalkylene glycols, are effective as polyhydric alcohols, and acids which have an HOOC—$R_2$—COOH structure (where $R_2$ represents a single bond or a hydrocarbon chain which has from 1 to about 12 carbon atoms) are effective as polybasic acids.

Examples of polyhydric alcohols include ethylene glycol, diethylene glycol, triethylene glycol, 1,2-propylene glycol, 1,3-propylene glycol, trimethylolpropane, 1,4-butanediol, isobutylenediol, 1,5-pentanediol, neopentyl glycol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, glycerin, diglycerin, triglycerin, 1-methylglycerin, erythritol, mannitol and sorbitol.

Examples of polybasic acids include oxalic acid, succinic acid, glutaric acid, adipic acid, pimelic acid, suberic acid, azelaic acid, sebacic acid, nonanedicarboxylic acid, decanedicarboxylic acid, undecanedicarboxylic acid, dodecanedicarboxylic acid, fumaric acid, maleic acid, itaconic acid, citraconic acid, phthalic acid, isophthalic acid, terephthalic acid, tetrachlorophthalic acid, metaconic acid, isohymelic acid, cyclopentadiene-maleic anhydride adducts and rosinmaleic anhydride adducts.

Examples of diamines include hydrazine, methylenediamine, ethylenediamine, trimethylenediamine, tetramethylenediamine, hexamethylenediamine, dodecylmethylenediamine, 1,4-diaminocyclohexane, 1,4-diaminomethylcyclohexane, o-aminoaniline, p-aminoaniline, 1,4-diaminomethylbenzene and bis(4-aminophenyl) ether.

Examples of ω-amino-ω-carboxylic acids include glycine, β-alanine, 3-aminopropanoic acid, 4-aminobutanoic acid, 5-aminopentanoic acid, 11-aminododecanoic acid, 4-aminobenzoic acid, 4-(2-aminoethyl)benzoic acid and 4-(4-aminophenyl)-butanoic acid.

Examples of diisocyanates include ethylenediisocyanate, hexamethylenediisocyanate, m-phenylenediisocyanate, p-phenylenediisocyanate, p-xylenediisocyanate and 1,5-naphthyldiisocyanate.

(C) Others

For example, polyesters and polyamides which are obtained by ring opening polymerization:

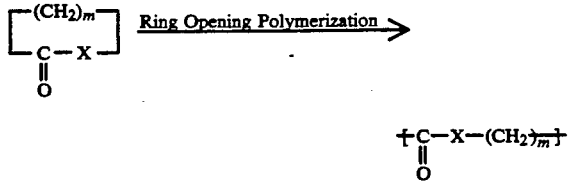

In this formula, X represents an —O— group or an —NH— group, and m represents an integer of value 4 to 7. The —$CH_2$— groups may be branched.

Monomers of this type include β-propiolactone, ε-caprolactone, dimethylpropiolactone, α-pyrrolidone, α-piperidone, ε-caprolactam and α-methyl-ε-caprolactam.

Monomers represented by the general formula indicated below can also be used.

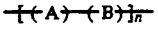

In this formula, A represents a repeating unit which has in the main chain at least one bond which is an ether bond or an —$SO_2$— bond. Moreover, B represents a repeating unit which has in the main chain at least one

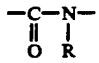

bond, ether bond,

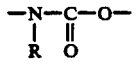

bond, —$SO_2$— bond or ester bond, or a single bond, and this may be the same as, or different from, A. R represents hydrogen, an alkyl group, aryl group or aralkyl group, and these groups may be substituted or unsubstituted groups. Moreover, n is an integer of value at least 5.

Two or more of the polymers of this invention described above can be used conjointly.

Among these polymers, the vinyl polymers are preferred as the polymers of this invention, and the use of acrylic based polymers, especially acrylamide based polymers, is especially desirable.

The molecular weights and degrees of polymerization of the polymers of this invention are not particularly limited, but problems arise with the increased time which is required to dissolve the polymer in an auxiliary solvent as the molecular weight increases, and emulsification and dispersion become more difficult because of the higher viscosity. Coarse particles are formed, and this can result in a worsening of coloring properties, and problems with coating properties are also liable to arise.

The use of a larger amount of auxiliary solvent and reduction of the solution viscosity to overcome these problems gives rise to new processing problems. From the point of view of the factors described above, the viscosity of the polymer is preferably such that the viscosity on dissolving 30 g of the polymer in 100 cc of the auxiliary solvent which is being used is less than 5,000 cps, and most desirably such that this solution viscosity is less than 2,000 cps. Furthermore, the molecular weight of the polymers which can be used in the invention is preferably less than 150,000 and most desirably less than 100,000.

In this invention, a "water-insoluble polymer" is a polymer of which the solubility in 100 g of distilled water is 3 g or less, and preferably 1 g or less.

The ratio of the polymer of this invention to the auxiliary solvent differs according to the type of polymer which is being used, and it varies over a wide range depending on the solubility in the auxiliary solvent, the degree of polymerization, and the solubility of the coupler. Normally, the amount of auxiliary solvent required to provide a sufficiently low viscosity such that the solution consisting of at least a coupler, a high boiling point organic solvent and a polymer in an auxiliary solvent can be dispersed easily in water or in an aqueous hydrophilic colloid solution is used. The viscosity of the solution increases as the degree of polymerization of the polymer increases and so it is difficult to generally define the ratio of polymer to auxiliary solvent irrespective of the type of polymer, but normally ratios within the range from 1:1 to 1:50 (by weight) are preferred. The proportion of polymer of this invention with respect to coupler (by weight) is preferably from 1:20 to 20:1, and most desirably from 1:10 to 10:1.

Specific examples of polymers which can be used in the invention are described below, but the invention is not to be construed as being limited to these examples. Ratios are by weight.

P- 1) Poly(methyl methacrylate)
P- 2) Poly(ethyl methacrylate)
P- 3) Poly(isopropyl methacrylate)
P- 4) Poly(methyl chloroacrylate)
P- 5) Poly(2-tert-butylphenyl acrylate)
P- 6) Poly(4-tert-butylphenyl acrylate)
P- 7) Ethyl methacrylate/n-butyl acrylate copolymer (70/30)
P- 8) Methyl methacrylate/acrylonitrile copolymer (65/35)
P- 9) Methyl methacrylate/styrene copolymer (90/10)
P-10) N-tert-Butylmethacrylamide/methyl methacrylate/acrylic acid copolymer (60/30/10)
P-11) Methyl methacrylate/styrene/vinylsulfonamide copolymer (70/20/10)
P-12) Methyl methacrylate/cyclohexyl methacrylate copolymer (50/50)
P-13) Methyl methacrylate/acrylic acid copolymer (95/5)
P-14) Methyl methacrylate/n-butyl methacrylate copolymer (65/35)
P-15) Methyl methacrylate/N-vinyl-2-pyrrolidone copolymer (90/10)
P-16) Poly(N-sec-butylacrylamide)
P-17) Poly(N-tert-butylacrylamide)
P-18) Cyclohexyl methacrylate/methyl methacrylate copolymer (60/40)
P-19) n-Butyl methacrylate/methyl methacrylate/acrylamide copolymer (20/70/10)
P-20) Diacetoneacrylamide/methyl methacrylate copolymer (20/80)
P-21) N-tert-Butylacrylamide/methyl methacrylate copolymer (40/60)
P-22) Poly(N-n-butylacrylamide) copolymer (50/50)
P-23) tert-Butyl methacrylate/N-tert-butylacrylamide copolymer (50/50)
P-24) tert-Butyl methacrylate/methyl methacrylate copolymer (70/30)
P-25) Poly(N-tert-butylacrylamide)
P-26) N-tert-Butylacrylamide/methyl methacrylate copolymer (60/40)
P-27) Methyl methacrylate/acrylonitrile copolymer (70/30)
P-28) Methyl methacrylate/styrene copolymer (75/25)
P-29) Methyl methacrylate/hexyl methacrylate copolymer (70/30)
P-30) Poly(4-biphenyl acrylate)
P-31) Poly(2-chlorophenyl acrylate)
P-32) Poly(4-chlorophenyl acrylate)
P-33) Poly(pentachlorophenyl acrylate)
P-34) Poly(4-ethoxycarbonylphenyl acrylate)
P-35) Poly(4-methoxycarbonylphenyl acrylate)
P-36) Poly(4-cyanophenyl acrylate)
P-37) Poly(4-methoxyphenyl acrylate)
P-38) Poly(3,5-dimethyladamantyl acrylate)
P-39) Poly(3-dimethylaminophenyl acrylate)
P-40) Poly(2-naphthyl acrylate)
P-41) Poly(phenyl acrylate)
P-42) Poly(N,N-dibutylacrylamide)
P-43) Poly(isohexylacrylamide)
P-44) Poly(isooctylacrylamide)
P-45) Poly(N-methyl-N-phenylacrylamide)
P-46) Poly(adamantyl methacrylate)
P-47) Poly(sec-butyl methacrylate)
P-48) N-tert-Butylacrylamide/acrylic acid copolymer (97/3)
P-49) Poly(2-chloroethyl methacrylate)
P-50) Poly(2-cyanoethyl methacrylate)
P-51) Poly(2-cyanomethylphenyl methacrylate)
P-52) Poly(4-cyanophenyl methacrylate)
P-53) Poly(cyclohexyl methacrylate)
P-54) Poly(2-hydroxypropyl methacrylate)
P-55) Poly(4-methoxycarbonylphenyl methacrylate)
P-56) Poly(3,5-dimethyladamantyl methacrylate)
P-57) Poly(phenyl methacrylate)
P-58) Poly(4-butoxycarbonylphenylmethacrylamide)
P-59) Poly(4-carboxyphenylmethacrylamide)
P-60) Poly(4-ethoxycarbonylphenylmethacrylamide)
P-61) Poly(4-methoxycarbonylphenylmethacrylamide)
P-62) Poly(cyclohexyl chloroacrylate)
P-63) Poly(ethyl chloroacrylate)
P-64) Poly(isobutyl chloroacrylate)
P-65) Poly(isopropyl chloroacrylate)

Suitable methods for synthesizing the polymer used in the invention are well-known in the art.

SYNTHESIS EXAMPLE 1

Preparation of Methyl Methacrylate Polymer (P-3)

Methyl methacrylate (500 g), 0.5 g of poly(sodium acrylate) and 200 ml of distilled water were introduced into a 500 ml three-necked flask and the mixture was heated to 80° C. with stirring under a blanket of nitrogen. Dimethyl azobisisobutyrate (500 mg) was added as a polymerization initiator and polymerization started.

The reaction mixture was cooled after polymerizing for a period of 2 hours, and 48.7 g of Polymer P-3 was obtained by recovering by filtration, and washing with water, the polymer which had been formed in the form of beads.

SYNTHESIS EXAMPLE 2

Preparation of t-Butylacrylamide Polymer (P-17)

A mixture of 500 g of t-butylacrylamide and 250 ml of toluene was introduced into a 500 ml three-necked flask and heated to 80° C. with stirring under a blanket of nitrogen. A toluene solution (10 ml) containing 500 mg of azobisisobutyronitrile was added as a polymerization initiator and polymerization was started.

The reaction mixture was cooled after polymerizing for a period of 3 hours, and 47.9 g of Polymer P-17 was obtained on recovering by filtration of the solid which precipitated out on pouring the mixture into 1 liter of hexane, washing the solid with hexane, and drying the product by heating under reduced pressure.

Dispersions of lipophilic fine particles containing coupler, high boiling point coupler solvent and polymer of this invention can be prepared as indicated below.

The polymer of this invention, being a linear polymer prepared by a solution polymerization procedure, an emulsion polymerization procedure or a suspension polymerization procedure, etc. (without crosslinking), the high boiling point coupler solvent and the coupler are all dissolved completely in an auxiliary organic solvent and the resulting solution is dispersed in the form of fine particles in water, or preferably in an aqueous hydrophilic colloid solution and most desirably in an aqueous gelatin solution, with the aid of a dispersing agent, using ultrasonics or a colloid mill, for example, and this dispersion is included in the silver halide emulsion. Alternatively, water or an aqueous hydrophilic colloid solution such as an aqueous gelatin solution can be added to an auxiliary organic solvent which contains a dispersion promotor such as a surfactant, the polymer of this invention, the high boiling point coupler solvent and the coupler and an oil-in-water dispersion can be formed by phase reversal. The auxiliary solvent may be removed from the dispersion so prepared by distillation, noodle washing or by ultrafiltration, for example, after which the dispersion may be mixed with a photographic emulsion. The term "auxiliary solvent" as used herein signifies an organic solvent which is used at the time of emulsification and dispersion but which is ultimately eliminated from the photosensitive material during the drying process at the time of coating or by the methods mentioned above, for example. These solvents are low boiling point organic solvents or solvents which have some solubility in water and which can be removed by washing with water. Examples of such auxiliary solvents include the acetates of lower alcohols, such as ethyl acetate and butyl acetate, ethyl propionate, sec-butyl alcohol, methyl ethyl ketone, methyl isobutyl ketone, β-ethoxyethyl acetate, methyl cellosolve acetate, methylcarbitol acetate, methylcarbitol propionate and cyclohexanone.

Moreover, an organic solvent which is completely miscible with water, such as methyl alcohol, ethyl alcohol, acetone or tetrahydrofuran, can be used conjointly, as required.

Furthermore, two or more of these organic solvents can be used conjointly.

The fine lipophilic particles (oil droplets) are included in a silver halide emulsion layer or adjacent layers to the silver halide emulsion layer, preferably in a silver halide emulsion layer.

The average particle size of the fine lipophilic particles obtained in this way is preferably from 0.04 μm to 2 μm, and most preferably from 0.06 μm to 0.4 μm. The particle size of the fine lipophilic particles can be measured using a device such as the "Nanosizer" made by the British Coal Tar Co.

Various photographically useful hydrophobic substances can also be included in the fine lipophilic particles of this invention. Examples of such photographically useful hydrophobic substances include colored couplers, non-color-forming couplers, developing agents, developing agent precursors, development inhibitor precursors, ultraviolet absorbers, development accelerators, gradation controlling agents such as hydroquinones, dyes, dye-releasing agents, antioxidants, fluorescent whiteners, and antifading agents. Furthermore, these hydrophobic substances can be used conjointly.

Furthermore, the compounds of formulae (A) to (C) indicated below improve the color-forming properties and increase the fading prevention of this invention. Their use is especially effective as photographically useful hydrophobic substances which are included in the fine lipophilic particle of this invention which contains coupler, high boiling point organic solvent and polymer.

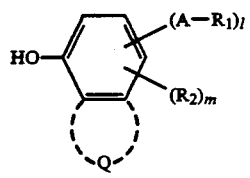

(A)

wherein A represents a divalent electron-attracting group; $R_1$ represents a substituted or unsubstituted alkyl group, a substituted or unsubstituted aryl group, a substituted or unsubstituted alkoxy group, a substituted or unsubstituted aryloxy group, a substituted or unsubstituted alkylamino group, a substituted or unsubstituted anilino group, or a substituted or unsubstituted heterocyclic group; and l is an integer of 1 or 2; $R_2$ represents a substituted or unsubstituted alkyl group, a substituted or unsubstituted alkoxy group, a hydroxyl group or a halogen atom; and m is 0 or an integer from 1 to 4; Q represents a benzene ring or a heterocyclic ring which may be condensed with the phenol ring.

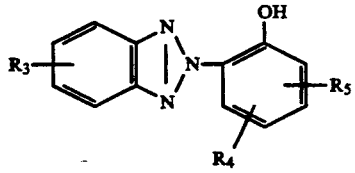

(B)

wherein $R_3$, $R_4$ and $R_5$, which may be the same or different, each represents hydrogen, a halogen atom, a nitro group, a hydroxyl group or a substituted or unsubstituted alkyl, alkoxy, aryl, aryloxy or acylamino group.

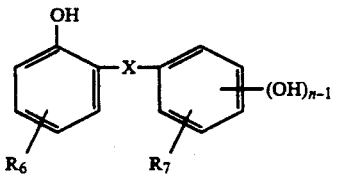

(C)

wherein $R_6$ and $R_7$ each represents hydrogen or a substituted or unsubstituted alkyl group, alkoxy group or acyl group; X represents —CO— or —COO—; and n is an integer of 1 to 4.

Specific examples of compounds which can be represented by formulae (A) to (C) are indicated below, but the invention is not to be construed as being limited to these examples.

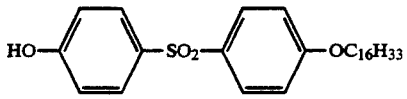

(X-1)

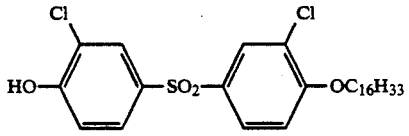

(X-2)

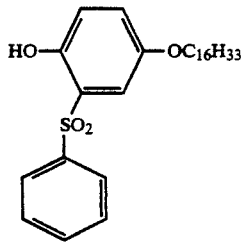

(X-3)

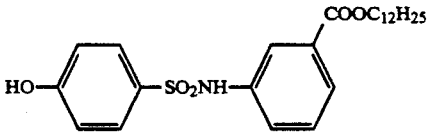

(X-4)

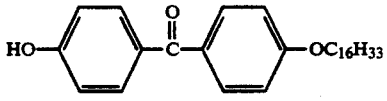

(X-5)

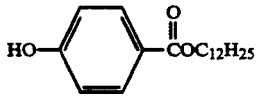

(X-6)

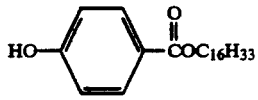

(X-7)

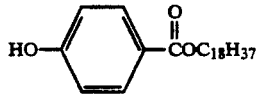

(X-8)

-continued

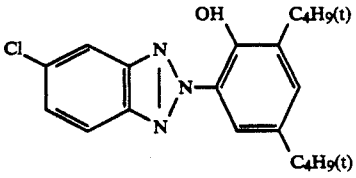

(X-9)

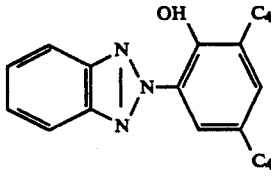

(X-10)

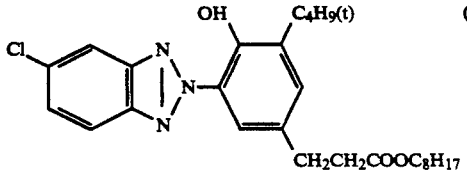

(X-11)

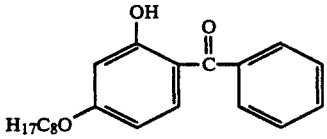

(X-12)

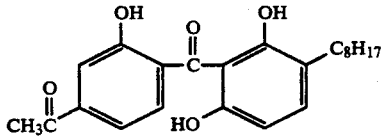

(X-13)

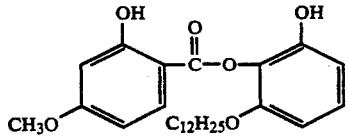

(X-14)

No particular limitation is imposed on the halogen composition of the silver halide grains used in the invention, but the use of essentially silver iodide free silver chlorobromides in which at least 20 mol % (average value) of all the silver halide in the same silver halide emulsion layer consists of silver chloride is preferred. Here, the term "essentially silver iodide free" signifies a silver iodide content of not more than 1 mol %. Further, the use of essentially silver iodide free silver halides in which at least 80 mol % (average value) of all the silver halide in the same silver halide emulsion layer consists of silver chloride is more preferred. Most preferred silver halide consists of from 0 to 1 mol % of silver iodide, 95 mol % or more of silver chloride and the remainder of silver bromide. Essentially silver iodide free silver chlorobromides in which at least 95 mol % of all the silver halide in the same silver halide emulsion layer consists of silver chloride are especially desirable halogen compositions for the silver halide grains in cases where rapid processing is envisaged. Furthermore, in cases where such high silver chloride grains are used, it is preferred that the grains have a local silver bromide phase which has a silver bromide content of more than 10 mol % but less than 70 mol %. The arrangement of such a local silver bromide phase is variable, depending on the intended purpose, and it may be in the interior of the silver halide grains, or in the surface or sub-surface parts of the silver halide grains, or it may be divided between the interior and surface or sub-surface regions of the silver halide grains. Furthermore, the local phase may have a layer-like structure surrounding the silver halide grains internally or at the surface, or it may have a discontinuous, isolated structure. As an example of a preferred arrangement, a silver bromide local phase of which the silver bromide content is at least 10 mol %, and preferably in excess of 20 mol %, is grown locally on the surface of the silver halide grains (even on the corners).

The silver bromide content of the local phase is preferably in excess of 20 mol %, but if the silver bromide content is too high the photosensitive material may be desensitized when pressure is applied, and undesirable characteristics in the photosensitive material such as marked variation in speed and gradation due to variations in processing bath composition arise. In consideration of these points, the silver bromide content of the local phase is preferably within the range from 20 to 60 mol %, and most desirably within the range from 30 to 50 mol %. The other silver halide of the local phase is preferably silver chloride. The silver bromide content of the local phase can be measured, for example, using the X-ray diffraction method (for example, as described in the Japanese Chemical Society publication *New Experimental Chemistry Series 6, Structural Analysis,* published by Maruzen), or the XPS method (for example, as described in *Surface Analysis—Application of IMA, and Auger Electron and Photoelectron Spectra,* published by Kodansha). The local phase is preferably formed using from 0.1 to 20%, and most desirably from 0.5 to 7%, of the total amount of silver used to form the silver halide grains in this invention.

The boundary between such a local phase and the other phase may be a distinct phase boundary or the silver halide composition may change gradually to form a short transition region. The position of the silver bromide local phase can be ascertained by observation using an electron microscope or by using the method described in European Patent Application (Laid Open) 273,430.

Various methods can be employed to form a silver bromide local phase of this type. For example, a soluble silver salt and a soluble halide can be reacted using a one sided or simultaneous mixing method to form a local phase. Moreover, the local phase can be formed using the conversion method, which includes a process in which silver halide which has already been formed is converted to another silver halide which has a lower solubility product. Alternatively, a local phase can be formed by adding fine silver bromide grains and recrystallizing these grains onto the surface of silver chloride grains.

These methods have been described, for example, in the specification of European Patent Application (Laid Open) 273,430.

The local phase is preferably precipitated along with at least 50% of all the iridium which is added during the formation of the silver halide grains.

Here, the term "precipitated together with the iridium" signifies that an iridium compound is supplied at the same time as the silver and/or halide is being supplied to form the local phase, or immediately before or immediately after adding the silver and/or halide.

The preferred silver halide grains in this invention may have a (100) plane or a (111) plane for the outer surface, or they may have both of these planes for outer surfaces, and they may include higher order planes.

The form of the silver halide grains used in the invention may be a regular crystalline form, such as cubic, tetradecahedral or octahedral form, an irregular crystalline form, such as a spherical or tabular form, or a composite form consisting of these crystalline forms. Mixtures of grains which have various crystalline forms can also be used, but in such mixtures the presence of at least 50%, preferably at least 70%, and most desirably at least 90%, of grains which have a regular crystalline form is desirable.

The silver halide emulsions used in the invention may be emulsions in which tabular grains of which the average aspect ratio (length/thickness ratio) is at least 5, and most desirably at least 8, account for at least 50% of the total projected area of the grains.

The size of the silver halide grains in this invention may be within the range normally used, but an average grain size within the range from 0.1 μm to 1.5 μm is preferred. The grain size distribution may be polydispersed or monodispersed, but monodispersions are preferred. The particle size distribution which represents the extent of monodispersivity is preferably such that the statistical variation coefficient (the value S/d obtained by dividing the standard deviation S by the diameter d in cases where the projected area is approximately circular) is not more than 20%, and most desirably not more than 15%.

Two or more types of tabular grain emulsions and monodispersed emulsions of this type can be mixed together. In cases in which emulsions are mixed together, at least one emulsion preferably has a variation coefficient as described above, and the variation coefficient of the mixed emulsion is preferably within the above range of values.

Apart from the local phase of the silver halide grains, the substrate may have different phases for the interior and surface parts or it may consist of a uniform phase.

Silver halide photographic emulsions which can be used in the invention can be prepared using the methods described, for example, *Chemie et Physique Photographique,* by P. Glafkides, published by Paul Montel, 1967; *Photographic Emulsion Chemistry,* by G. F. Duffin, published by Focal Press, 1966; and *Making and Coating Photographic Emulsions,* by V. L. Zelikman et al., published by Focal Press, 1964, etc.

Silver halide solvents, for example, ammonia, potassium thiocyanate, ammonium thiocyanate, thioether compounds (for example, those disclosed in U.S. Pat. Nos. 3,271,157, 3,574,628, 3,704,130, 4,297,439 and 4,276,374), thione compounds (for example, those disclosed in JP-A-53-144319, JP-A-53-82408 and JP-A-55-77737) and amine compounds (for example, those disclosed in JP-A-54-100717, can be used to control grain growth during the formation of the silver halide grains.

The silver halide grains used in the invention are essentially of the surface latent image type, and some degree of chemical sensitization of the surface is desirable. Chemical sensitization can be achieved using sulfur sensitization methods in which use is made of active gelatin or compounds which contain sulfur which can react with silver (for example, thiosulfates, thioureas, mercapto compounds and rhodanines), reduction sensitization methods in which use is made of reducing substances (for example, stannous salts, amines, hydrazine derivatives, formamidinesulfinic acid and silane compounds) and precious metal sensitization methods in which use is made of metal compounds (for example, gold complex salts, and complex salts of metals of group VIII of the Periodic Table, such as Pt, Ir, Pd, Rh and Fe), and these methods may be used individually or in combination.

Details of these methods are disclosed from line 18 of the lower left column on page 12 to line 16 of the lower right column on the same page of the specification of JP-A-62-215272.

The sensitive materials of this invention typically have a blue-sensitive layer, a green-sensitive layer and a red-sensitive layer established in this order on a support, or the order of the layers can be changed appropriately. At least one layer of each color sensitivity is coated and layers in which spectral sensitization in the prescribed wavelength region has been provided using sensitizing dyes are preferred.

The methine dyes such as the cyanine dyes and merocyanine dyes normally used for photographic purposes can be used as spectrally sensitizing dyes. Examples of these sensitizing dyes are disclosed at pages 77 to 124 of JP-A-62-215272.

Hydroquinone derivatives, aminophenol derivatives, gallic acid derivatives and ascorbic acid derivatives can be used, for example, as anti-color-fogging agents in the photosensitive materials of this invention.

Various antifading agents can be used in the photosensitive materials of this invention. Examples of compounds which can be used as organic antifading agents for use with the cyan, magenta and/or yellow images include hydroquinones, 6-hydroxychromans, 5-hydroxycoumarans, spirochromans, p-alkoxyphenols, hindered phenols based on bisphenols, gallic acid derivatives, methylenedioxybenzenes, aminophenols, hindered amines, and ether or ester derivatives of those compounds wherein the phenolic hydroxyl groups have been silylated or alkylated. Furthermore, metal complexes as typified by (bissalicylaldoximato)nickel and (bis-N,N-dialkyldithiocarbamato)nickel can also be used for this purpose.

Examples of organic antifading agents have been disclosed in the specifications of the patents indicated below.

Hydroquinone derivatives have been disclosed, for example, in U.S. Pat. Nos. 2,360,290, 2,418,613, 2,700,453, 2,701,197, 2,728,659, 2,732,300, 2,735,765, 3,982,944 and 4,430,425, British Patent 1,363,921 and U.S. Pat. Nos. 2,710,801 and 2,816,028; 6-hydroxychromans, 5-hydroxycoumarans and spirochromans have been disclosed, for example, in U.S. Pat. Nos. 3,432,300, 3,573,050, 3,574,627, 3,698,909 and 3,764,337, and in JP-A-52-152225; spiroindanes have been disclosed in U.S. Pat. No. 4,360,589; p-alkoxyphenols have been disclosed, for example, in U.S. Pat. No. 2,735,765, British Patent 2,066,975, JP-A-59-10539 and JP-B-57-19765 (the term "JP-B" as used herein refers to an "examined Japanese patent publication"); hindered phenols have been disclosed, for example, in U.S. Patent 3,700,455, JP-A-52-72224, U.S. Patent 4,228,235 and JP-B-52-6623; gallic acid derivatives, methylenedioxybenzenes and aminophenols have been disclosed, for example, in U.S. Pat. Nos. 3,457,079 and 4,332,886 and JP-B-56-21144, respectively; hindered amines have been disclosed, for example, in U.S. Pat. Nos. 3,336,135 and 4,268,593, British Patents 1,326,889, 1,354,313 and 1,410,846, JP-B-51-1420, JP-A-58-114036, JP-A-59-53846 and JP-A-59-78344; ether and ester derivatives of phenolic hydroxyl groups have been disclosed, for example, in U.S. Pat. Nos. 4,155,765, 4,174,220, 4,254,216 and 4,264,720, JP-A-54-145530, JP-A-55-6321, JP-A-58-105147, JP-A-59-10539, JP-B-57-37856, U.S. Pat. No. 4,279,990 and JP-B-53-3263; and metal complexes have been disclosed, for example, in U.S. Pat. Nos. 4,050,938 and 4,241,155, and in British Patent 2,027,731(A). These compounds can be used to achieve the intended purpose by addition to the photosensitive layer after coemulsification with the coupler in an amount normally ranging from 5 to 100 wt % with respect to the corresponding color coupler. The introduction of ultraviolet absorbers into the layers on both sides adjacent to the cyan color forming layer is effective for preventing deterioration of the cyan dye image due to heat and, more especially, light.

The spiroindanes and hindered amines are especially desirable among the above-mentioned antifading agents.

The use, together with the aforementioned couplers, and especially with the pyrazoloazole based couplers, of compounds such as those indicated below is preferred in this invention.

Thus, the use alone or in combination of a compound (A) which bonds chemically with any aromatic amine based developing agent remaining after color development processing and produces chemically inactive and essentially colorless compounds and/or a compound (B) which bonds chemically with any of the oxidized form of the aromatic amine based developing agent remaining after color development processing and produces chemically inactive and essentially colorless compounds is desirable for preventing the occurrence of staining and other side effects due to the reaction of residual color developing agent or oxidized form of the color developing agent in the film with a coupler and colored dye formation during storage after processing.

Compound (A) is preferably a compound which reacts with p-anisidine with a second order reaction rate constant $k_2$ (at 80° C. in trioctyl phosphate) within the range from 1.0 liter/mol.sec to $1\times10^{-5}$ liter/mol.sec.

If the value of $k_2$ is larger than this range, the compound itself will be unstable and it may react with gelatin or water and decompose. If, on the other hand, the value of $k_2$ is smaller than this range, reaction with the residual aromatic amine based developing agents is slow and it is not possible to prevent the occurrence of the side reactions of the residual aromatic amine based developing agents which is the purpose of the invention. The most desirable compounds (A) of this type are represented by formulae (AI) or (AII):

$$R_1-(A)_n-X \qquad \text{(AI)}$$

$$R_2-\underset{\underset{B}{|}}{C}=Y \qquad \text{(AII)}$$

wherein $R_1$ and $R_2$ each represents an aliphatic group, aromatic group or heterocyclic group; B represents hydrogen, an aliphatic group, aromatic group, heterocyclic group, acyl group or sulfonyl group; and Y represents a group which promotes the addition of aromatic amine based developing agents to the compounds of formula (AII); here, $R_1$ and X, and Y and $R_2$ or B, may be linked to form a ring structure.

Substitution reactions and addition reactions are typical of the forms of chemical bonding with residual aromatic amine based developing agents.

Typical examples of compounds which can be represented by formulae (AI) and (AII) have been disclosed, for example, in Japanese Patent Application Nos. 62-158342, 62-158643, 62-212258, 62-214681, 62-228034 and 62-279843.

Ultraviolet absorbers may be included in the hydrophilic colloid layers in the photosensitive materials of this invention. For example, benzotriazole compounds substituted with aryl groups (as disclosed, for example, in U.S. Pat. No. 3,533,794), 4-thiazolidone compounds (as disclosed, for example, in U.S. Pat. Nos. 3,314,794 and 3,352,681), benzophenone compounds (as disclosed, for example, in JP-A-46-2784), cinnamic acid ester compounds (as disclosed, for example, in U.S. Pat. Nos. 3,705,805 and 3,707,375), butadiene compounds (as disclosed, for example, in U.S. Pat. No. 4,045,229), and benzoxidol compounds (as disclosed, for example, in U.S. Pat. No. 3,700,455) can be used for this purpose. Ultraviolet absorbing couplers (for example, α-naphthol based cyan dye forming couplers) and ultraviolet absorbing polymers can also be used for this purpose. These ultraviolet absorbing agents can be mordanted in specified layers.

Water-soluble dyes may be included as filter dyes or for anti-irradiation or various other purposes in the hydrophilic colloid layers of photosensitive materials made using this invention. Dyes of this type include oxonol dyes, hemioxonol dyes, styryl dyes, merocyanine dyes, cyanine dyes and azo dyes. The oxonol dyes, hemioxonol dyes and merocyanine dyes are useful among these dyes.

The use of gelatin is effective as the binding agent or protective colloid which is used in the emulsion layers of photosensitive materials of this invention, but other protective colloids can be used, either individually or in combination with gelatin.

The gelatin used in the invention may be a lime treated gelatin or an acid treated gelatin. Details of methods for the preparation of gelatins have been described by Arthur Weise in *The Macromolecular Chemistry of Gelatin* (published by Academic Press, 1964).

Cellulose nitrate films, transparent films of polyethylene terephthalate or reflective type supports as normally used for photographic materials can be used for the supports which are used in the present invention. The use of a reflective type support is preferred, in line with the purpose of the invention.

The term "reflective support" used in this invention signifies that the reflectance is high and that the dye image formed in the silver halide emulsion layer is clear, and such reflective supports include those in which the support is covered with a hydrophobic resin which contains a dispersion of a light reflecting substance such as titanium oxide, zinc oxide, calcium carbonate or calcium sulfate, for example, and those in which hydrophobic resins which contain light reflecting substances are used for the support itself. For example, use can be made of baryta paper, polyethylene coated paper, polypropylene based synthetic papers, and transparent supports such as glass plates, polyester films such as polyethylene terephthalate, cellulose triacetate and cellulose nitrate films, polyamide films, polycarbonate films, polystyrene films and vinyl chloride resin films on which a reflecting layer has been established or in which a reflecting substance has been used conjointly, and the supports can be selected appropriately according to the intended purpose of the resulting material.

White pigments may be milled thoroughly in the presence of a surfactant as light reflecting materials and the use of those white pigments of which the surfaces of the fine pigment particles have been treated with a di-hydric to tetra-hydric alcohol is preferred.

The occupied area factor (%) for the area occupied by fine white pigment particles per specified unit surface area can be obtained most typically by dividing the area observed into adjoining unit areas measuring 6 μm×6 μm and measuring the occupied area factor (%) ($R_i$) of the fine grains projected in each unit area. The variation factor of the occupied area factor (%) can be obtained using the ratio $s/\overline{R}$ of the standard deviation s of $R_i$ with respect to the average value of $R_i$ ($\overline{R}$). The number of unit areas taken as subjects for observation is preferably at least six. Hence, the variation coefficient $s/\overline{R}$ can be obtained from the following expression:

$$\sqrt{\frac{\sum_{i=1}^{n}(R_i-\overline{R})^2}{n-1}} \Big/ \frac{\sum_{i=1}^{n}R_i}{n}$$

In this invention, the variation factor of the occupied area factor (%) of the fine pigment grains is preferably not more than 0.15, and most desirably not more than 0.12. The dispersion of the particles can be said to be "uniform" when the variation coefficient has a value of not more than 0.08.

As well as the normal exposure system in which a single surface exposure is made, scanning exposure methods can be used for exposing the sensitive materials of this invention. Methods in which a combination of a laser and a wavelength varying element consisting of a non-linear optical material is used to provide a second harmonic for the light source as disclosed in JP-A-63-113534 are preferred for making such scanning exposures.

The conventional color development processing which can be used after exposing the material in this way is described below.

The color development baths used for color development processing are preferably aqueous alkaline solutions which contain primary aromatic amine based color developing agents as the principal components. Aminophenol based compounds are useful as color developing agents, but the use of p-phenylenediamine based compounds is preferred. Typical examples of these compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and the sulfate, hydrochloride and p-toluenesulfonate salts of these compounds. Two or more of these compounds can be used conjointly, depending on the intended purpose.

The color development baths generally contain pH buffers, such as alkali metal carbonates, borates or phosphates, and development inhibitors or antifogging agents, such as bromides, iodides, benzimidazoles, benzothiazoles or mercapto compounds. They may also contain, as required, various preservatives, such as hydroxylamine, diethylhydroxylamine, sulfites, hydrazines, phenylsemicarbazides, triethanolamine, catechol sulfonic acids, triethylenediamine(1,4-diazabicyclo[2,2,-

2]octane), organic solvents such as ethylene glycol and diethylene glycol, development accelerators such as benzyl alcohol, poly(ethylene glycol), quaternary ammonium salts and amines, dye forming couplers, competitive couplers, fogging agents such as sodium borohydride, auxiliary developing agents such as 1-phenyl-3-pyrazolidone, viscosity imparting agents, various chelating agents, as typified by the aminopolycarboxylic acids, aminopolyphosphonic acids, alkylphosphonic acids and phosphonocarboxylic acids, typical examples of which include ethylenediaminetetraacetic acid, nitrilotriacetic acid, diethylenetriaminepentaacetic acid, cyclohexanediaminetetraacetic acid, hydroxyethylimidinoacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine di(o-hydroxyphenylacetic acid), and salts of these compounds.

Color development is carried out after a normal black-and-white development in the case of reversal processing. The known black-and-white developing agents, for example, dihydroxybenzenes such as hydroquinone, 3-pyrazolidones such as 1-phenyl-3-pyrazolidone, and aminophenols such as N-methyl-p-aminophenol, can be used individually, or in combinations, in these black-and-white development baths.

The pH of these color development baths and black-and-white development baths is generally within the range from 9 to 12. Furthermore, the replenishment rate of these development baths depends on the color photographic material which is being processed, but it is generally 3 liters or less per square meter of photosensitive material and it is possible, by reducing the bromide ion concentration in the replenisher, to use replenishment rates of 500 ml or less per square meter of photosensitive material. The prevention of loss of liquid by evaporation, and aerial oxidation, by minimizing the contact area with the air in the processing tank is desirable in cases where the replenishment rate is low. The replenishment rate can be reduced further by suppressing the accumulation of bromide ion in the developer.

The photographic emulsion layers are subjected to a normal bleaching process after color development. The bleaching process may be carried out at the same time as the fixing process (in a bleach-fix process) or it may be carried out as a separate process. Moreover, a bleach-fix process can be carried out after a bleaching process in order to speed-up processing. Moreover, processing can be carried out in two connected bleach-fix baths, a fixing process can be carried out before carrying out a bleach-fix process, or a bleaching process can be carried out after a bleach-fix process, according to the intended purpose of the processing. Compounds of a multivalent metal, such as iron(III), cobalt(III), chromium(VI) and copper(II), peracids, quinones and nitro compounds can be used, for example, as bleaching agents. Typical bleaching agents include ferricyanides; dichromates; organic complex salts of iron(III) or cobalt(III), for example, complex salts with aminopolycarboxylic acids, such as ethylenediaminetetraacetic acid, diethylenetriaminepentaacetic acid, cyclohexanediaminetetraacetic acid, methyliminodiacetic acid, 1,3-diaminopropanetetraacetic acid and glycol ether diaminetetraacetic acid, or citric acid, tartaric acid, malic acid; persulfates; bromates; permanganates and nitrobenzenes. Of these materials, the use of the aminopolycarboxylic acid iron(III) complex salts, principally ethylenediaminetetraacetic acid iron(III) complex salts, and persulfates, is preferred both for rapid processing and the prevention of environmental pollution. Moreover, the aminopolycarboxylic acid iron(III) complex salts are especially useful in both bleach baths and bleach-fix baths. The pH of a bleach or bleach-fix bath in which aminopolycarboxylic acid iron(III) complex salts are being used is normally from 5.5 to 8. Processing can be speeded up by using a bleach-fixing solution having preferably a pH of 6.0 or less, and more preferably a pH of 5.5 or less.

Bleach accelerators can be used, as required, in the bleach baths, bleach-fix baths, or bleach or bleach-fix prebaths. Examples of useful bleach accelerators have been disclosed in the following specifications: the compounds which have a mercapto group or a disulfide group disclosed, for example, in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426 and *Research Disclosure*, No. 17129 (July, 1978); the thiazolidine derivatives disclosed in JP-A-50-140129; the thiourea derivatives disclosed in JP-B-45-8506, JP-A-52-20832, JP-A-53-32735 and U.S. Pat. No. 3,706,561; the iodides disclosed in West German Patent 1,127,715 and JP-A-58-16235; the polyoxyethylene compounds disclosed in West German Patents 966,410 and 2,748,430; the polyamine compounds disclosed in JP-B-45-8836; the other compounds disclosed in JP-A-49-42434, JP-A-49-59644, JP-A-53-94927, JP-A-54-35727, JP-A-55-26506 and JP-A-58-163940; and bromide ions. Among these compounds, those which have a mercapto group or a disulfide group are preferred in view of their large accelerating effect, and the use of the compounds disclosed in U.S. Pat. No. 3,893,858, West German Patent 1,290,812 and JP-A-53-95630 is especially preferred. Moreover, the use of the compounds disclosed in U.S. Pat. No. 4,552,834 is also preferred. These bleach accelerators may be added to the sensitive material. These bleach accelerators are especially effective when bleach-fixing camera color photosensitive materials.

Thiosulfates, thiocyanates, thioether based compounds, thioureas, and large quantities of iodides can be used as fixing agents, but thiosulfates are generally used for this purpose and ammonium thiosulfate, in particular, can be used in the widest range of applications. Sulfites or bisulfites, or carbonyl-bisulfite addition compounds, are preferred as preservatives for bleach-fix baths.

The silver halide color photographic materials of this invention are generally subjected to water washing and/or stabilizing process after the desilvering process. The amount of water used in the water washing process can be fixed within a wide range according to the nature of the photosensitive material (for example, the materials, such as couplers, which are being used), the application, the wash water temperature, the number of washing tanks (the number of washing stages), the replenishment system, i.e., whether a counter flow or a sequential flow system is used, and various other conditions. The relationship between the amount of water used and the number of water washing tanks in a multi-stage counter flow system can be obtained using the method outlined on pages 248 to 253 of the *Journal of the Society of Motion Picture and Television Engineers*, Vol. 64 (May, 1955).

The amount of wash water can be greatly reduced by using the multistage counter flow system there described, but bacteria proliferate due to the increased residence time of the water in the tanks and problems arise as a result of the sediments which are formed becoming attached to the photosensitive material. The method in which the calcium ion and manganese ion concentrations are reduced disclosed in JP-A-62-288838 can be used very effectively to overcome problems of this sort in the processing of color photosensitive materials of this invention. Furthermore, the isothiazolone compounds and thiabendazoles disclosed in JP-A-57-8542, and chlorine based disinfectants such as chlorinated sodium isocyanurate, and benzotriazoles, and the disinfectants disclosed in *Chemistry of Biocides and Fungicides by* Horiguchi, *Killing Microorganisms, Biocidal and Fungicidal Techniques,* published by the Health and Hygiene Technical Society, and in *A Dictionary of Biocides and Fungicides,* published by the Japanese Biocide and Fungicide Society, can be used for this purpose.

The pH of the wash water used in the processing of the photosensitive materials of the invention is within the range from 4 to 9, and preferably within the range from 5 to 9. The wash water temperature and the washing time can be set variously according to the nature of the photosensitive material and the application, etc., but, in general, washing conditions of from 20 seconds to 10 minutes at a temperature of from 15° C. to 45° C., and preferably of from 30 seconds to 5 minutes at a temperature of from 25° C. to 40° C., are selected. Moreover, the photosensitive materials of this invention can be processed directly in a stabilizing bath instead of being subjected to a water wash as described above. The known methods disclosed in JP-A-57-8543, JP-A-58-14834 and JP-A-60-220345 can all be used for this purpose.

Furthermore, there are cases in which a stabilization process is carried out following the water washing process, and the stabilizing baths which contain formalin and surfactant which are used as a final bath for camera color photosensitive materials are an example of such a process. Various chelating agents and fungicides can be added to these stabilizing baths.

The overflow which accompanies replenishment of the above-mentioned wash water and/or stabilizer can be reused in other processes such as the desilvering process.

A color developing agent may also be incorporated into the silver halide color photosensitive materials of this invention in order to simplify and speed-up processing. The use of various color developing agent precursors is preferred for such incorporation. For example, the indoaniline based compounds disclosed in U.S. Pat. No. 3,342,597, the Schiff's base type compounds disclosed in U.S. Pat. No. 3,342,599 and *Research Disclosure,* Nos. 14850 and 15159, the aldol compounds disclosed in *Research Disclosure,* No. 13924, the metal salt complexes disclosed in U.S. Pat. No. 3,719,492, and the urethane based compounds disclosed in JP-A-53-135628 can be used for this purpose.

Various 1-phenyl-3-pyrazolidones can be incorporated, as required, into the silver halide color photosensitive materials of this invention with a view to accelerating color development. Typical compounds of this type have been disclosed, for example, in JP-A-56-64339, JP-A-57-144547 and JP-A-58-115438.

The various processing baths in this invention are used at a temperature of from 10° C. to 50° C. The standard temperature is normally from 33° C. to 38° C., but processing is accelerated and the processing time is shortened at higher temperatures and, conversely, increased picture quality and improved stability of the processing baths can be achieved at lower temperatures. Furthermore, processes using hydrogen peroxide intensification or cobalt intensification as disclosed in West German Patent 2,226,770 or U.S. Pat. No. 3,674,499 can be carried out in order to economize on silver in the photosensitive material.

In order to realize the excellent characteristics of the silver halide photographic photosensitive materials of this invention, the silver halide color photographic photosensitive material which has on a single layer reflecting support at least one photosensitive layer which contains silver halide grains and at least one type of coupler which forms, a dye by means of a coupling reaction with the oxidized form of a primary aromatic amine based color developing agent is preferably processed for a developing time of not more than 2 minutes 30 seconds in a color development bath which is essentially benzyl alcohol free and which contains not more than 0.002 mol/liter of bromide ions.

The term "essentially benzyl alcohol free" as used above signifies that the benzyl alcohol concentration is less than 2 ml per liter, and preferably less than 0.5 ml per liter, of color development bath, and most preferably that the color development bath contains no benzyl alcohol at all.

The invention is now described in greater detail with reference to the following specific examples, but the present invention is not to be construed as being limited thereto. Unless otherwise indicated, all parts, percents and ratios are by weight.

EXAMPLE 1

The multilayer silver halide photosensitive material Sample 101 having the layer structure indicated below was prepared on a paper support which had been laminated on both sides with polyethylene. Moreover, ethyl acetate was used as an auxiliary solvent together with the high boiling point organic solvent for the coupler solvents referred to below.

Layer Structure

The composition of each layer was as indicated below. The values indicate coated weights (g/m$^2$). The weights of silver halide emulsions are indicated as weights calculated as silver.

Support

Polyethylene laminated paper (white pigment ($TiO_2$) and ultramarine dye were included in the polyethylene on the first layer side)

| | |
|---|---|
| First Layer: Blue-Sensitive Layer | |
| Monodispersed silver chlorobromide emulstion (EM1) spectrally sensitized with the sensitizing dye (ExS-1) | 0.16 |
| Monodispersed silver chlorobromide emulsion (EM2) spectrally sensitized with the sensitizing dye (ExS-1) | 0.10 |
| Gelatin | 1.06 |
| Colored image stabilizer (Cpd-1) | 0.02 |
| Yellow coupler (Y-17) | 0.83 |
| Solvent (SV-2 and SV-6, 1/1 by volume) | 0.35 |
| Polymer for dispersion purposes (P-17) | 0.10 |
| Second Layer: Anti-Color Mixing Layer | |
| Gelatin | 0.99 |
| Anti-color-mixing agent (Cpd-3) | 0.03 |
| Solvent (SV-3) | 0.06 |

-continued

| | |
|---|---|
| Third Layer: Green-Sensitive Layer | |
| Monodispersed silver chlorobromide emulsion (EM3) spectrally sensitized with the sensitizing dyes (ExS-2, ExS-3) | 0.05 |
| Monodispersed silver chlorobromide emulsion (EM4) spectrally sensitized with the sensitizing dyes (ExS-2, ExS-3) | 0.11 |
| Gelatin | 1.80 |
| Magenta coupler (M-5) | 0.39 |
| Colored image stabilizer (Cpd-4) | 0.20 |
| Colored image stabilizer (Cpd-5) | 0.05 |
| Colored image stabilizer (Cpd-6) | 0.04 |
| Solvent (SV-3) | 0.12 |
| Solvent (SV-1) | 0.25 |
| Fourth Layer: Ultraviolet Absorbing Layer | |
| Gelatin | 1.60 |
| Ultraviolet absorber (Cpd-7/Cpd-8/Cpd-9 = 3/2/6, by weight) | 0.70 |
| Anti-color-mixing agent (Cpd-3) | 0.05 |
| Solvent (SV-7) | 0.27 |
| Fifth Layer: Red-Sensitive Layer | |
| Monodispersed silver chlorobromide emulsion (EM5) spectrally sensitized with the sensitizing dyes (ExS-4, ExS-5) | 0.07 |
| Monodispersed silver chlorobromide emulsion (EM6) spectrally sensitized with the sensitizing dyes (ExS-4, ExS-5) | 0.16 |
| Gelatin | 0.92 |
| Cyan coupler (C-3) | 0.17 |
| Cyan coupler (C-11) | 0.15 |
| Colored image stabilizer (Cpd-1) | 0.03 |
| Colored image stabilizer (Cpd-5) | 0.01 |
| Colored image stabilizer (Cpd-6) | 0.01 |
| Ultraviolet absorber (Cpd-7/Cpd-8/Cpd-9) = 4/8/9, by weight) | 0.30 |
| Solvent (SV-6) | 0.20 |
| Polymer for dispersion purposes (P-17) | 0.30 |
| Sixth Layer: Ultraviolet Absorbing Layer | |
| Gelatin | 0.54 |
| Ultraviolet absorber (Cpd-7/Cpd-8/Cpd-9 = 1/5/3, by weight) | 0.21 |
| Anti-Color-mixing agent (Cpd-3) | 0.02 |
| Solvent (SV-7) | 0.06 |
| Seventh Layer: Protective Layer | |
| Gelatin | 1.33 |
| Acrylic modified copolymer of poly(vinyl alcohol) (degree of modification 17%) | 0.17 |
| Liquid paraffin | 0.03 |

In the fifth layer, two kinds of cyan coupler, three kinds of colored image stabilizer, ultraviolet absorber and polymer for dispersion were dissolved in ethyl acetate and a mixture of the solution thus obtained and solvent (SV-6) were dispersed to form an emulsion into an aqueous gelatin solution in the presence of dodecylbenzenesulfonic acid (surfactant) with a high speed homogenizer. The emulsified dispersion thus obtained was one containing fine grains. The surfactant was used in an amount of 1/10 (by weight) the above additives. Then, the emulsified dispersion and silver halide emulsion were mixed to be used for coating.

Furthermore, Cpd-11 and Cpd-12 were used as anti-irradiation dyes. Moreover, "Alkanol XC" (made by the Du Pont Co.), sodium alkylbenzenesulfonate, succinic acid esters and "Megafac F-120" (made by the Dainippon Ink co.) were used in each layer as emulsification, dispersion and coating promotors. Cpd-13 and Cpd-14 were used as silver halide stabilizers.

Furthermore, 1-oxy-3,5-dichloro-s-triazine, sodium salt, was used as a gelatin hardening agent in each layer, and Cpd-2 was used as a viscosity increasing agent.

Details of the emulsions used are indicated below.

| Emulsion | Form | Average Grain Size (μm) | Br Content (mol %) | Variation Coefficient |
|---|---|---|---|---|
| EM1 | Cubic | 0.96 | 80 | 0.06 |
| EM2 | Cubic | 0.64 | 80 | 0.07 |
| EM3 | Cubic | 0.52 | 70 | 0.08 |
| EM4 | Cubic | 0.40 | 70 | 0.09 |
| EM5 | Cubic | 0.44 | 70 | 0.09 |
| EM6 | Cubic | 0.36 | 70 | 0.08 |

Variation Coefficient = Standard Deviation/Average Grain Size

Illustrative high boiling point organic solvents for comparative purposes

| | | Viscosity (25° C.) |
|---|---|---|
| SV-1 | 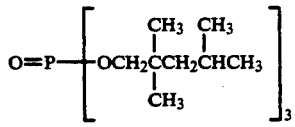 | 11.7 cp |
| SV-2 | 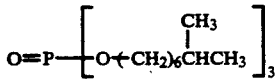 | 36.3 cp |
| SV-3 | 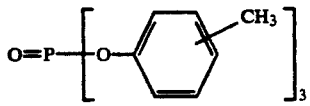 | 57.6 cp |
| SV-4 | 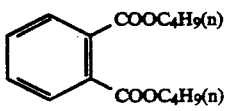 | 20.3 cp |
| SV-5 | 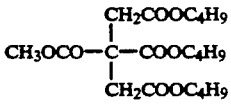 | 42.7 cp |

-continued
Illustrative high boiling point organic solvents for comparative purposes
| | | Viscosity (25° C.) |
|---|---|---|
| SV-6 | $C_8H_{17}CH(O)CH(CH_2)_7COOC_8H_{17}(n)$ | 29.8 cp |
| SV-7 | $(CH_2)_8(COOC_8H_{17}^{EM})_2$ | 19.9 cp |
| SV-8 | $CH_3CH(OCO\text{-}C_6H_5)COOC_{18}H_{37}(iso)$ | 323 cp |
| SV-9 | $HO\text{-}C(CH_2COOC_{13}H_{27}(iso))_3$ | 390 cp |
| ExS-1 | 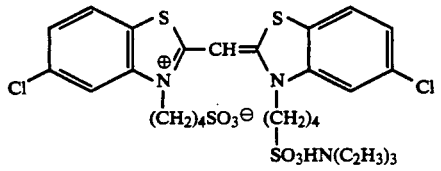 $6 \times 10^{-4}$ mol/mol Ag | |
| ExS-2 | 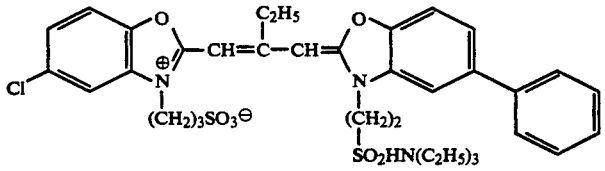 $4 \times 10^{-4}$ mol/mol Ag | |
| ExS-3 | 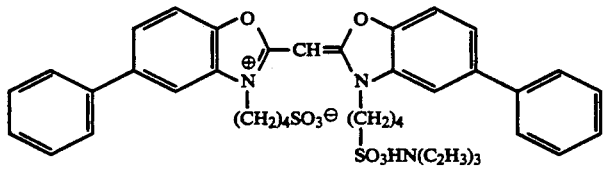 $8 \times 1^{-5}$ mol/mol Ag | |
| ExS-4 | 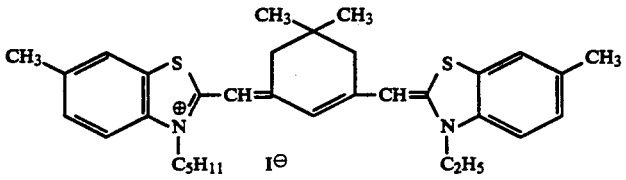 $1.8 \times 10^{-4}$ mol/mol Ag | |

-continued
Illustrative high boiling point organic solvents for comparative purposes
Viscosity (25° C.)
ExS-5
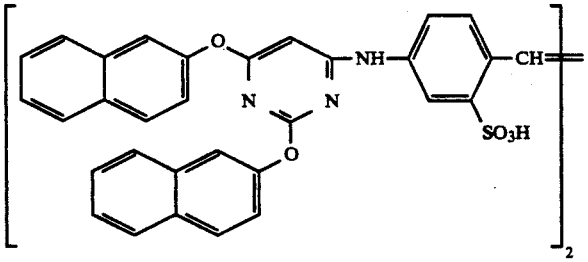
Cpd-1
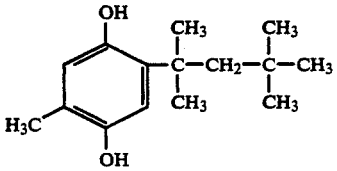
Cpd-2
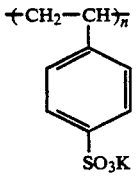
Cpd-3
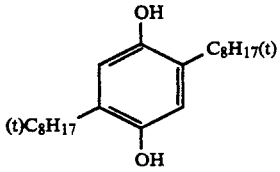
Cpd-4
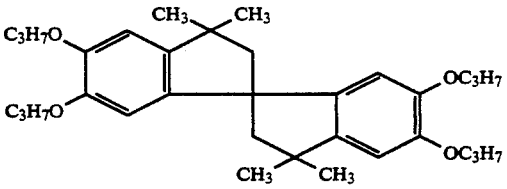
Cpd-5
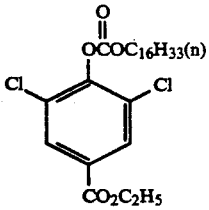
Cpd-6
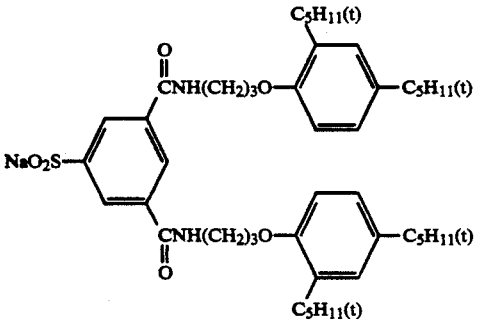

-continued
Illustrative high boiling point organic solvents for comparative purposes
Viscosity (25° C.)
Cpd-7
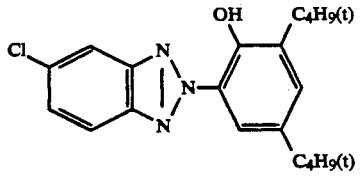
Cpd-8
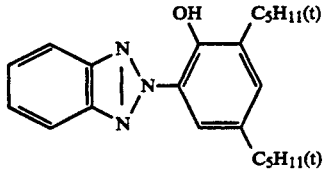
Cpd-9
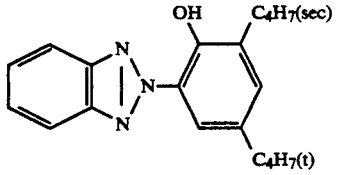
Cpd-10
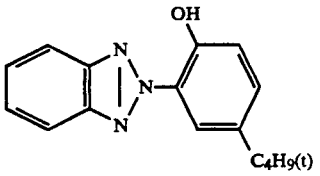
Cpd-11
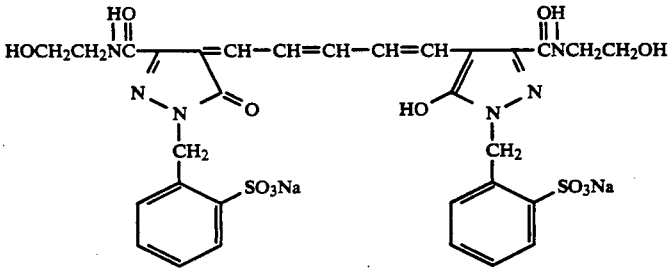
Cpd-12
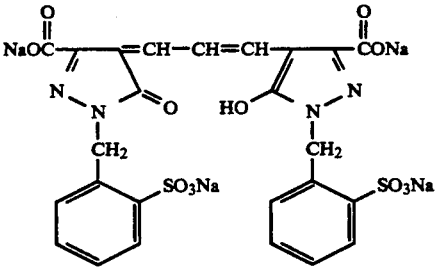
Cpd-13
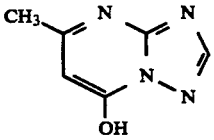

-continued

| Illustrative high boiling point organic solvents for comparative purposes | | Viscosity (25° C.) |
|---|---|---|
| Cpd-14 | 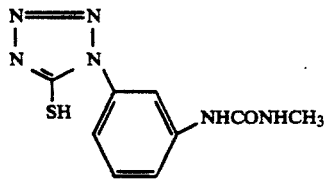 | |

Samples 102 to 130 were prepared in the same way as Sample 101 except that the type of polymer used for dispersion purposes and the type of high boiling point solvent in the red-sensitive layer of Sample 101 were modified as shown in Table 1.

TABLE 1

| Sample | High Boiling Point Solvent | Polymer for Dispersion Purposes |
|---|---|---|
| 101 C* | SV-6 | P-17 |
| 102 C | SV-6 | — |
| 103 C | SV-1 | — |
| 104 C | SV-3 | — |
| 105 C | SV-4 | — |
| 106 C | SV-7 | — |
| 107 C | SV-8 | — |
| 108 C | S-1 | — |
| 109 C | — | P-17 |
| 110 C | S-16 | — |
| 111 C | S-19 | — |
| 112 C | S-21 | — |
| 113 C | S-8 | — |
| 114 C | S-9 | — |
| 115 C | S-20 | — |
| 116 C | SV-1 | P-17 |
| 117 C | SV-3 | P-53 |
| 118 C | SV-4 | P-17 |
| 119 C | SV-5 | P-3 |
| 120 C | SV-8 | P-25 |
| 121 I* | S-1 | P-17 |
| 122 I | S-5 | P-3 |
| 123 I | S-16 | P-16 |
| 124 I | S-19 | P-17 |
| 125 I | S-21 | P-17 |
| 126 I | S-8 | P-47 |
| 127 I | S-9 | P-53 |
| 128 I | S-20 | P-22 |
| 129 I | S-5 | P-17 |
| 130 I | S-5 | P-25 |

*C = Comparative Example, I = Example of the Invention

The above-mentioned photosensitive materials were subjected to a gray exposure, after which running tests were carried out using a Fuji Color Paper Processor Model PP600 using the processing operations indicated below until the system had been replenished to twice the volume of the color developing tank.

| Processing Operation | Temperature (°C.) | Time | Replenishment Rate* (ml) | Tank Volume (l) |
|---|---|---|---|---|
| Color Development | 38 | 1 min 40 sec | 290 | 17 |
| Bleach-Fix | 33 | 60 sec | 150 | 9 |
| Rinse (1) | 30–34 | 20 sec | — | 4 |
| Rinse (2) | 30–34 | 20 sec | — | 4 |
| Rinse (3) | 30–34 | 20 sec | 364 | 4 |
| Drying | 70–80 | 50 sec | | |

*Per square meter of photosensitive material. (A three tank counter flow system from rinse (3) to rinse (1) was used.)

The composition of each of the processing baths was as indicated below.

| | Tank Solution | Replenisher |
|---|---|---|
| Color Development Bath | | |
| Water | 800 ml | 800 ml |
| Diethylenetriaminepentaacetic acid | 1.0 g | 1.0 g |
| Nitrilotriacetic acid | 2.0 g | 2.0 g |
| 1-Hydroxyethylidene-1,1-diphosphonic acid | 2.0 g | 2.0 g |
| Benzyl alcohol | 16 ml | 16 ml |
| Diethylene glycol | 10 ml | 10 ml |
| Sodium sulfite | 2.0 g | 2.5 g |
| Potassium bromide | 0.5 g | — |
| Potassium carbonate | 30 g | 30 g |
| N-Ethyl-N-(β-methanesulfonamidoethyl)-3-methyl-4-aminoaniline hydrochloride | 5.5 g | 5.5 g |
| Hydroxylamine sulfate | 2.0 g | 2.5 g |
| Fluorescent whitener ("Whitex 4B" made by Sumitomo Chemicals) | 1.5 g | 2.0 g |
| Water to make | 1,000 ml | 1,000 ml |
| pH (25° C.) | 10.20 | 10.60 |
| Bleach-Fix Bath | | |
| Water | 400 ml | 400 ml |
| Ammonium thiosulfate solution (70%) | 200 ml | 200 ml |
| Sodium sulfite | 20 g | 40 g |
| Ethylenediaminetetraacetic acid Fe (III) ammonium salt | 60 g | 120 g |
| Ethylenediaminetetraacetic acid disodium salt | 5 g | 10 g |
| Water to make | 1,000 ml | 1,000 ml |
| pH (25° C.) | 6.70 | 6.30 |

Rinse Bath

Deionized water (calcium and magnesium ion concentrations both less than 3 ppm)

Samples 101 to 130 prepared in this way were subjected to a gray exposure and processed in the same way as before and the resulting samples were subjected to a fading test with fungi which was carried out in the way described below.

Fungi which had grown on a color paper were cultured on a potato dextrose agar medium, spores were collected and a spore suspension of concentration approximately $1.5\times10^6$ spores/ml was prepared. Next, 0.5 ml of the spore suspension was dripped onto each sample and the samples were maintained at 28° C. under conditions of 95% humidity for a period of 10 months, during which time fungi developed and propagated, and the extent of fading of the cyan image in the region in which the fungi had propagated was investigated.

The results observed for cyan dye fading are shown in Table 2, where a fading factor of more than about 40% is indicated by xx, a fading factor of at least 10% but less than 40% is indicated by x, a fading factor of at least 5% but less than 10% is indicated by o and a fading factor of less than 5% is indicated by. .

TABLE 2

| Sample No. | Type | Fading Factor |
|---|---|---|
| 101 | Comparison | x |
| 102 | " | xx |
| 103 | " | xx |
| 104 | " | xx |
| 105 | " | xx |
| 106 | " | xx |
| 107 | " | xx |
| 108 | " | xx |
| 109 | " | x |
| 110 | " | xx |
| 111 | " | xx |
| 112 | " | xx |
| 113 | " | xx |
| 114 | " | xx |
| 115 | " | xx |
| 116 | " | x |
| 117 | " | xx |
| 118 | " | x |
| 119 | " | xx |
| 120 | " | x |
| 121 | Invention | . |
| 122 | " | . |
| 123 | " | . |
| 124 | " | o |
| 125 | " | . |
| 126 | " | . |
| 127 | " | . |
| 128 | " | . |
| 129 | " | . |
| 130 | " | . |

It is clear from Table 2 that with the samples other than those of this invention, color changes leading to the formation of red spots appeared in the parts where the fungi had proliferated on the gray colored parts (tricolor yellow, magenta and cyan), which is to say that the cyan dye faded in these parts, whereas this phenomenon was not observed with the samples of this invention. Furthermore, the cyan coloration was remarkably low immediately after processing with Sample 109 which did not contain a high boiling point organic solvent and there were problems with the color forming properties in this case. Thus, by means of this invention the images can be preserved effectively with no cyan fading even when fungi develop on long term storage. Furthermore, the cyan images of the samples of this invention had a good hue and good light fastness.

EXAMPLE 2

Photosensitive material Samples 210 to 230 were prepared in the same way as the photosensitive material Samples 101 to 130 in Example 1 except that the silver halide emulsions and magenta couplers were changed as indicated below.

Thus, Emulsions EM1 and EM2 were replaced by Emulsion EM7, Emulsions EM3 and EM4 were replaced by Emulsion EM8, and Emulsions EM5 and EM6 were replaced by Emulsion EM9. The emulsions used were as follows:

| Emulsion | Form | Average Grain Size (μm) | Br Content (mol %) | Variation Coefficient |
|---|---|---|---|---|
| EM7 | Cubic | 0.85 | 0.6 | 0.10 |
| EM8 | Cubic | 0.45 | 1.00 | 0.09 |

-continued

| Emulsion | Form | Average Grain Size (μm) | Br Content (mol %) | Variation Coefficient |
|---|---|---|---|---|
| EM9 | Cubic | 0.34 | 1.8 | 0.10 |

Variation Coefficient = Standard Deviation/Average Grain Size

Furthermore, the magenta coupler was changed from M-5 in Example 1 to M-2.

The above-mentioned photosensitive materials were subjected to a gray exposure and then processed using the following processing operations.

| Processing Operation | Temperature (°C.) | Processing Time (sec) |
|---|---|---|
| Color Development | 35 | 45 |
| Bleach-Fix | 35 | 45 |
| Water Wash (1) | 35 | 30 |
| Water Wash (2) | 35 | 30 |
| Water Wash (3) | 35 | 30 |
| Drying | 75 | 60 |

(Three tank counter flow system from water wash (3) to water wash (1))

| | |
|---|---|
| Color Development Bath | |
| Water | 800 ml |
| Ethylenediamine-N,N,N',N'-tetramethylene-phosphonic acid | 3.0 g |
| Triehanolamine | 8.0 g |
| Sodium chloride | 1.4 g |
| Potassium carbonate | 25 g |
| N-Ethyl-N-(β-methanesulfonamidoethyl)-3-methyl-4-aminoaniline sulfate | 5.0 g |
| N,N-Bis(carboxyethyl)hydrazine | 5.0 g |
| Fluorescent whitener (Uvitex CK. made by Ciba-Geigy A.G.) | 1.0 g |
| Water to make | 1,000 ml |
| pH (25° C.) | 10.05 |
| Bleach-Fix Bath | |
| Water | 700 ml |
| Ammonium thiosulfate solution (700 g/liter) | 100 ml |
| Ammonium sulfite | 18 g |
| Ethylenediaminetetraacetic acid ferric ammonium salt dihydrate | 55 g |
| Ethylenediaminetetraacetic acid disodium salt | 3 g |
| Ammonium bromide | 40 g |
| Glacial acetic acid | 8 g |
| Water to make | 1,000 ml |
| pH (25° C.) | 5.5 |

Wash Water

Water which had been treated with an ion exchange resin so that calcium and magnesium concentrations were both less than 3 ppm was used. (The electrical conductivity at 25° C. was 5 μs/cm).

The processed Samples 201 to 230 were subjected to fading tests with fungi in the same way as in Example 1 and the results obtained were the same as those obtained in Example 1, confirming that fading due to fungi was effectively prevented in the samples of this invention irrespective of the type of silver halide emulsion or the type of development processing used.

EXAMPLE 3

The multilayer silver halide photosensitive material Sample 301 having the layer structure indicated below was prepared on a paper support which had been laminated on both sides with polyethylene.

Layer Structure

The composition of each layer was as indicated below. The values indicate coated weights ($g/m^2$). The weights of silver halide emulsions are indicated as weights calculated as silver.

Support

Polyethylene laminated paper (white pigment ($TiO_2$) and ultramarine dye were included in the polyethylene on the first layer side)

| | |
|---|---|
| First Layer: Blue-Sensitive Layer | |
| Monodispersed silver chlorobromide emulstion (EM7) spectrally sensitized with the sensitizing dye (ExS-7) | 0.27 |
| Gelatin | 1.86 |
| Yellow coupler (Y-17) | 0.82 |
| Solvent (SV-4) | 0.35 |
| Second Layer: Anti-Color-Mixing Layer | |
| Gelatin | 0.99 |
| Anti-color-mixing agent (Cpd-3) | 0.06 |
| Solvent (SV-3) | 0.12 |
| Third Layer: Green-Sensitive Layer | |
| Monodispersed silver chlorobromide emulsion (EM8) spectrally sensitized with the sensitizing dyes (ExS-3, ExS-6) | 0.45 |
| Gelatin | 1.24 |
| Magenta coupler (M-17) | 0.35 |
| Colored image stabilizer (Cpd-4) | 0.12 |
| Colored image stabilizer (Cpd-15) | 0.06 |
| Colored image stabilizer (Cpd-16) | 0.10 |
| Colored image stabilizer (Cpd-17) | 0.01 |
| Solvent (SV-1) | 0.25 |
| Solvent (SV-3) | 0.25 |
| Fourth Layer: Ultraviolet Absorbing Layer | |
| Gelatin | 1.60 |
| Ultraviolet absorber (Cpd-7/Cpd-8/Cpd-19 = 3/2/6, by weight) | 0.70 |
| Anti-color-mixing agent (Cpd-3) | 0.05 |
| Solvent (SV-7) | 0.42 |
| Fifth Layer: Red-Sensitive Layer | |
| Monodispersed silver chlorobromide emulsion (EM9) spectrally sensitized with the sensitizing dyes (ExS-4, ExS-5) | 0.20 |
| Gelatin | 0.92 |
| Cyan coupler (C-1) | 0.09 |
| Cyan coupler (C-51) | 0.03 |
| Cyan coupler (C-52) | 0.21 |
| Colored image stabilizer (Cpd-1) | 0.02 |
| Ultraviolet absorber (Cpd-7/Cpd-8/Cpd-9) = 4/8/9, by weight) | 0.19 |
| Solvent (SV-7) | 0.12 |
| Polymer for dispersion purposes (P-17) | 0.15 |
| Sixth Layer: Ultraviolet Absorbing Layer | |
| Gelatin | 0.54 |
| Ultraviolet absorber (Cpd-7/Cpd-8/Cpd-17 = 1/5/3, by weight) | 0.21 |
| Solvent (SV-7) | 0.08 |
| Seventh Layer: Protective Layer | |
| Gelatin | 1.33 |
| Acrylic modified copolymer of poly(vinyl lcohol) (degree of modification 17%) | 0.17 |
| Liquid paraffin | 0.03 |

Furthermore, Cpd-11 and Cpd-12 were used as anti-irradiation dyes at this time. Moreover, "Alkanol XC" (made by the Du Pont Co.), sodium alkylbenzene-sulfonate, succinic acid esters and "Megafac F-120" (made by the Dainippon Ink Co.) were used in each layer as emulsification, dispersion and coating promotors. Cpd-13 and Cpd-14 were used as silver halide stabilizers.

Furthermore, 1-oxy-3,5-dichloro-s-triazine, sodium salt, was used as a gelatin hardening agent in each layer, and Cpd-2 was used as a viscosity increasing agent.

Details of the emulsions used are indicated below.

| Emulsion | Form | Average Grain Size (μm) | Br Content (mol %) | Variation Coefficient |
|---|---|---|---|---|
| EM7 | Cubic | 0.85 | 0.6 | 0.10 |
| EM8 | Cubic | 0.45 | 1.00 | 0.09 |
| EM9 | Cubic | 0.34 | 1.8 | 0.10 |

Variation Coefficient = Standard Deviation/Average Grain Size

The compounds used were the same as those illustrated above, with the following additional compounds.

ExS-6

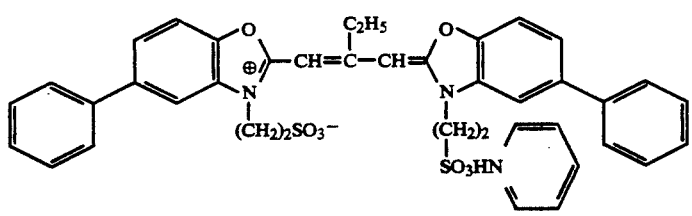

Ex-7

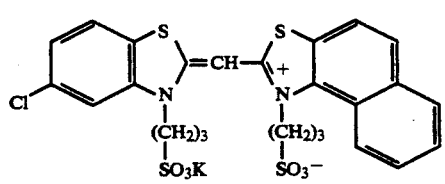

Cpd-15

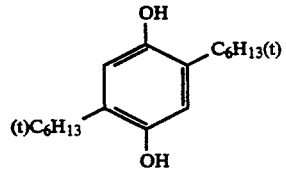

-continued

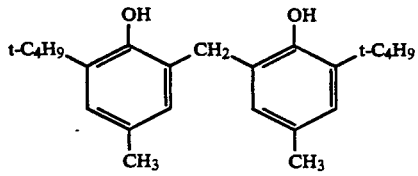

Cpd-16

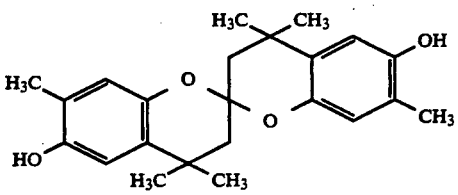

Cpd-17

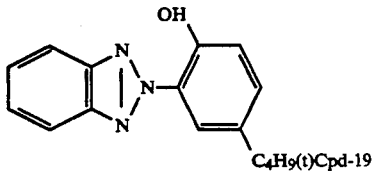

Cpd-19

Samples 302 to 330 were prepared in the same way as Sample 301 except that the type of polymer for dispersion purposes and the type of high boiling point organic solvent in the red-sensitive layer of Sample 301 were changed as shown in Table 3.

TABLE 3

| Sample | High Boiling Point Solvent | Polymer for Dispersion Purposes |
|---|---|---|
| 301 C* | SV-7 | P-17 |
| 302 C | SV-7 | — |
| 303 C | SV-2 | — |
| 304 C | SV-5 | — |
| 305 C | SV-9 | — |
| 306 C | — | — |
| 307 C | — | p-3 |
| 308 C | S-3 | — |
| 309 C | S-1 | — |
| 310 C | S-5 | — |
| 311 C | S-51 | — |
| 312 C | S-9 | — |
| 313 C | S-12 | — |
| 314 C | S-21 | — |
| 315 C | S-22 | — |
| 316 C | SV-7 | P-3 |
| 317 C | SV-2 | P-17 |
| 318 C | SV-5 | P-47 |
| 319 C | SV-9 | P-55 |
| 320 C | SV-8 | P-17 |
| 321 I* | S-3 | P-17 |
| 322 I | S-4 | P-17 |
| 323 I | S-8 | P-57 |
| 324 I | S-9 | P-53 |
| 325 I | S-12 | P-27 |
| 326 I | S-21 | P-22 |
| 327 I | S-22 | P-17 |
| 328 I | S-46 | P-17 |
| 329 I | S-49 | P-17 |
| 330 I | S-51 | P-17 |

*C = Comparative Example, I = Example of the Invention

These samples were subjected to a gray exposure in the same way as in Examples 1 and 2 and then they were processed using the same processing operations as described in Example 2, after which fading tests with fungi were carried out in the same way as in Examples 1 and 2. The results obtained are as shown in Table 4. (The standards used for evaluation were the same as those used in Example 1.)

TABLE 4

| Sample No. | Type | Fading Factor |
|---|---|---|
| 301 | Comparison | xx |
| 302 | " | xx |
| 303 | " | xx |
| 304 | " | xx |
| 305 | " | xx |
| 306 | " | xx |
| 307 | " | x |
| 308 | " | xx |
| 309 | " | xx |
| 310 | " | xx |
| 311 | " | xx |
| 312 | " | xx |
| 313 | " | xx |
| 314 | " | xx |
| 315 | " | xx |
| 316 | " | xx |
| 317 | " | x |
| 318 | " | xx |
| 319 | " | xx |
| 320 | " | x |
| 321 | Invention | o |
| 322 | " | |
| 323 | " | |
| 324 | " | |
| 325 | " | o |
| 326 | " | |
| 327 | " | |
| 328 | " | |
| 329 | " | |
| 330 | " | |

It is clear from Table 4 that there is a marked improvement in respect of cyan fading due to fungi in the case of this invention. Furthermore, as in Examples 1 and 2, with Samples 306 and 307 which did not contain any high boiling point organic solvent there was a pronounced worsening of cyan color formation while with the samples of this invention the color forming properties were satisfactory and the images could be stored effectively under adverse conditions without image deterioration even when fungi developed.

Thus, color photographs which have a good hue (color reproducibility) and good light fastness, and which exhibit little fading due to fungi can be obtained by this invention.

While the invention has been described in detail and with reference to specific embodiments thereof, it will be apparent to one skilled in the art that various changes and modifications can be made therein without departing from the spirit and scope thereof.

What is claimed is:

1. A method of forming a color image comprising developing an exposed light-sensitive silver halide photographic material composed of a support having thereon at least one light-sensitive silver halide emulsion layer, containing silver halide grains having a halogen composition from 0 to 1 mol % of silver iodide, 95 mol % or more silver chloride and the remainder silver bromide, said at least one light-sensitive silver halide emulsion layer or an adjacent layer thereto containing an oil droplet dispersion in a hydrophilic binder, the oil droplets containing the combination of (a) a polymer insoluble in water and soluble in an organic solvent; (b) a high boiling point organic solvent having the formula (III):

$$W_1—COOW_2 \quad \text{(III)}$$

wherein $W_1$ and $W_2$, which may be the same or different, each represents a substituted or unsubstituted alkyl, cycloalkyl, alkenyl, aryl or heterocyclic group; and having a viscosity at 25° C. of at least 500 cp and a boiling point of at least 120° C.; and (c) at least one coupler capable of forming a nondiffusible cyan dye by a coupling reaction with an oxidized form of a primary aromatic amine developing agent with a color developing solution which is essentially benzyl alcohol free.

* * * * *